US005371573A

United States Patent [19]

Kagaya et al.

[11] Patent Number: 5,371,573

[45] Date of Patent: Dec. 6, 1994

[54] IMAGE FORMING APPARATUS PROVIDING A SHEET TRAY IN THE IMAGE FORMING SECTION WHEN THE STACKING DEVICE IS FILLED

[75] Inventors: Koji Kagaya; Kesao Shindo; Takashi Matsuoka; Satoshi Onuma, all of Kanagawa, Japan

[73] Assignee: Kabushiki Kaisha Toshiba, Kawasaki, Japan

[21] Appl. No.: 36,874

[22] Filed: Mar. 25, 1993

[30] Foreign Application Priority Data

Mar. 25, 1992 [JP] Japan ..... 4-067637

[51] Int. Cl.[5] ..... G03G 21/00

[52] U.S. Cl. ..... 355/207; 355/322

[58] Field of Search ..... 355/205, 207, 323, 204, 355/309, 322; 271/9, 279, 215, 217

[56] References Cited

U.S. PATENT DOCUMENTS

| | | | |
|---|---|---|---|
| 4,295,733 | 10/1981 | Janssen et al. | 355/323 |
| 4,358,197 | 11/1982 | Kukucka et al. | 355/322 |
| 4,411,515 | 10/1983 | Kukucka et al. | 355/322 X |
| 4,522,486 | 6/1985 | Clark et al. | 355/322 |
| 4,927,131 | 5/1990 | Hashimoto et al. | 271/215 |
| 4,994,865 | 2/1991 | Nishimori et al. | 355/322 |
| 5,049,946 | 9/1991 | Harada | 355/309 |
| 5,151,735 | 9/1992 | Yamashita et al. | 355/207 |

FOREIGN PATENT DOCUMENTS

| | | | |
|---|---|---|---|
| 63-154547 | 6/1988 | Japan | 271/9 |
| 63-171770 | 7/1988 | Japan . | |
| 2-013537 | 1/1990 | Japan | 271/9 |

*Primary Examiner*—A. T. Grimley
*Assistant Examiner*—Shuk Y. Lee
*Attorney, Agent, or Firm*—Foley & Lardner

[57] ABSTRACT

An image forming system for forming an image on a sheet includes a first receiving section and a second receiving section. A first transporting section transports the sheet-to the first receiving section. A second transporting section transports the sheet to the second receiving section. A selecting section selects either the first receiving section or the second receiving section. A detector detects that the second receiving section is in an abnormal condition while the selecting section selects the second receiving section. The selection of the selecting section is changed from the second receiving section to the first receiving section corresponding to the detection of the detector. The second transporting section is driven until all the sheets in the second transporting section are transported to the second receiving section.

7 Claims, 23 Drawing Sheets

ADD 7

IMAGE FORMING APPARATUS PROVIDING A SHEET TRAY IN THE IMAGE FORMING SECTION WHEN THE STACKING DEVICE IS FILLED

BACKGROUND OF THE INVENTION

1. Field of the Invention

This invention relates to an image forming system having an image forming device, such as an electrophotographic printer, for forming an image on a recording medium, and a stacking device connected to the image forming device for receiving the printed recording medium on which the image is formed.

2. Description of Prior Art

Generally, an image forming system has an image forming device, a paper feeding device and a paper stacking device. The image forming device receives a sheet of paper and forms an image thereon. After the image is formed, the printed sheet is transported to the paper stacking device.

Recently, in the stacking device art there has been recognized a need to rapidly stack a plurality of sheets, because the image forming device forms the image on the sheet at a high speed. For example, to this end, Japanese Patent disclosure (Kokai) No. 63-171770. Ono et al., discloses a stacking device having a mechanism which receives a plurality of printed sheets. In the stacking device, there are a sheet tray and an elevator mechanism. The elevator mechanism moves the sheet tray vertically in response to the height of the stacked sheets.

The stacking device, further, has a second tray positioned over the sheet tray. When it is impossible to stack the next printed sheet on the sheet tray, such as in a paper full condition, a cover open condition, and the like, the sheet is transported to the second tray.

Moreover, the types of systems are increasing in which a stacking device as an optional device is connected to the image forming device. In the case in which the stacking device is an optional device, it is necessary that an exit tray be arranged in the image forming device because some user will often buy the image forming device only.

However, there is a problem in this system. That is, when the exit tray is arranged in the image forming device, the transporting path from the image forming device to the stacking device is longer than that of such a device in which the sheet tray is arranged in the stacking device. Further, in the case there is an another optional device between the image forming device and the stacking device, the transporting path is longer than that of this system. Consequently, if the sheet is being transported in the transporting path when the stacking operation becomes impossible, sheet jamming will occur in the transporting path.

SUMMARY OF THE INVENTION

Accordingly, it is an object of the present invention to provide an image forming system which permits completion of an image forming operation when a stacking device is included as an optional device.

It is another object of the present invention to provide an image forming system which permits changing from a sheet tray in a stacking device to a sheet tray in the image forming device without a sheet jamming when the sheet tray in the stacking device is full.

It is a further object of the present invention to provide an image forming system which permits changing from a sheet tray in a stacking device to a sheet tray in the image forming device without a sheet jamming when a cover of the stacking device is opened.

Accordingly, the foregoing objectives, as well as others, are achived by the present invention, which provides an image forming system forming an image on a recording medium comprising, means for forming the image on the recording medium, first receiving means for receiving the recording medium on which the image is formed by the forming means, first transporting means for transporting the recording medium from the image forming means to the first receiving means, second receiving means for receiving the recording medium on which the image is formed by the forming means second transporting means for transporting the recording medium from the image forming means to the second receiving means, means for selecting one of the first receiving means and the second receiving means, means for detecting that the second receiving means is in an abnormal condition while the selecting means selects the second receiving means, means for changing the selection of the selecting means from the second receiving means to the first receiving means corresponding to the detection of the detecting means, and means for driving the second transporting means until all of the recording medium in the second transporting means has been transported to the second receiving means after tile changing operation by the changing means.

A further aspect of the present invention provides an image forming method comprising the steps of, forming an image on an recording medium, transporting the recording medium to a first receiving device for receiving the recording medium, detecting if the first receiving device is abnormal, changing a destination of a following recording medium from the first receiving device to a second receiving device in response to the detection, continuing the transportation of the recording medium until all remaining recording medium which the transportation has started before the detection is transported to the first receiving device irrespective of the detection, and forbidding the transportation of the recording medium to the first receiving device after all the remaining recording medium has been transported.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENT

Figure 1:
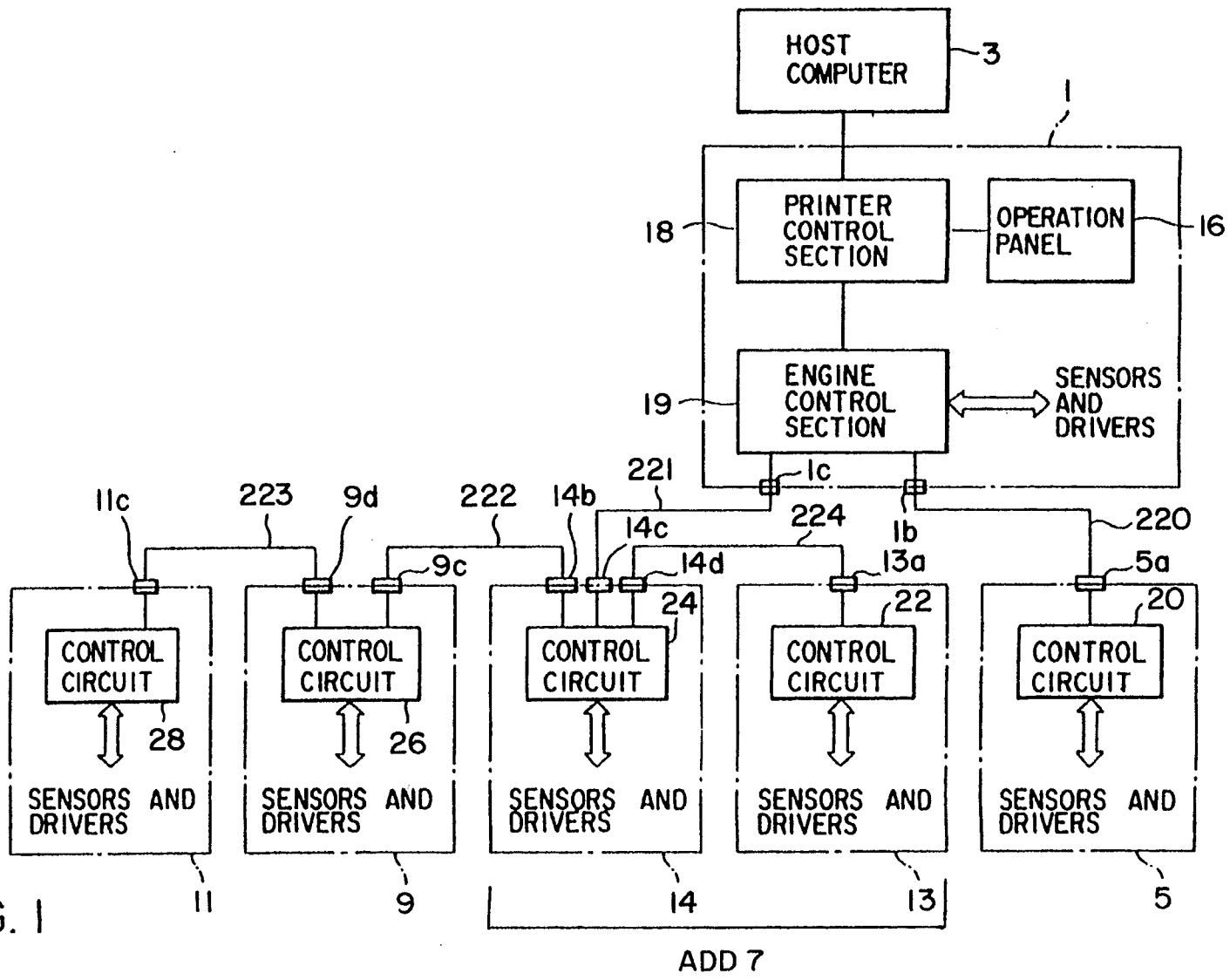
FIG. 1 is a block diagram showing an image forming system according to the present invention.

FIG. 1 shows an image forming system according to the present invention. The image forming system includes a laser printer 1 as an image forming device and several optional devices. Laser printer 1 receives data from a host computer 3 (i.e., an external device) and forms on a sheet of paper an image represented by the data. The optional devices are a multi paper feeder ("MPF") 5, an automatic duplexer device ("ADD") 7, a large-capacity feeder ("LCF") 9 and a large-capacity stacker ("LCS") 11 as a stacking device. The optional devices are connected to laser printer 1, some directly thereto, and the others indirectly thereto. ADD 7 includes a paper-reversing section 13 and a paper-feeding section 14.

Laser printer 1 includes an operation panel 16, a printer control section 18, an engine control section 19, and various sensors and drivers (not shown).

Operation panel 16 is mounted on the top of the housing of laser printer 1. Operation panel 16 is operated by a user input various operation instructions to printer control section 18. Printer control section 18 receives image data from host computer 3 and converts the data into digital image data and controls engine control section 19. Engine control section 19 controls the various components incorporated in laser printer 1, so that these components accomplish an electrophotographic process, thereby printing, on a sheet of paper, the image represented by the digital image data supplied from printer control section 18. Each of MPF 5, paper-receiving section 13, paper-feeding section 14, LCF 9 and LCS 11 includes a control circuit and sensors and drivers. More specifically, MPF 5 includes a control circuit 20 and sensors and drivers (not shown). Paper-reversing section 13 includes a control circuit 22 and sensors and drivers (not shown). Paper-feeding section 14 includes a control circuit 24 and sensors and drivers (not shown). LCF 9 includes a control circuit 26 and sensors and drivers (not shown). LCS 11 includes a control circuit 28 and sensors and drivers (not shown). These optional devices are assigned ID numbers. The ID numbers are stored in a memory (not shown) incorporated in laser printer 1.

Figure 2:
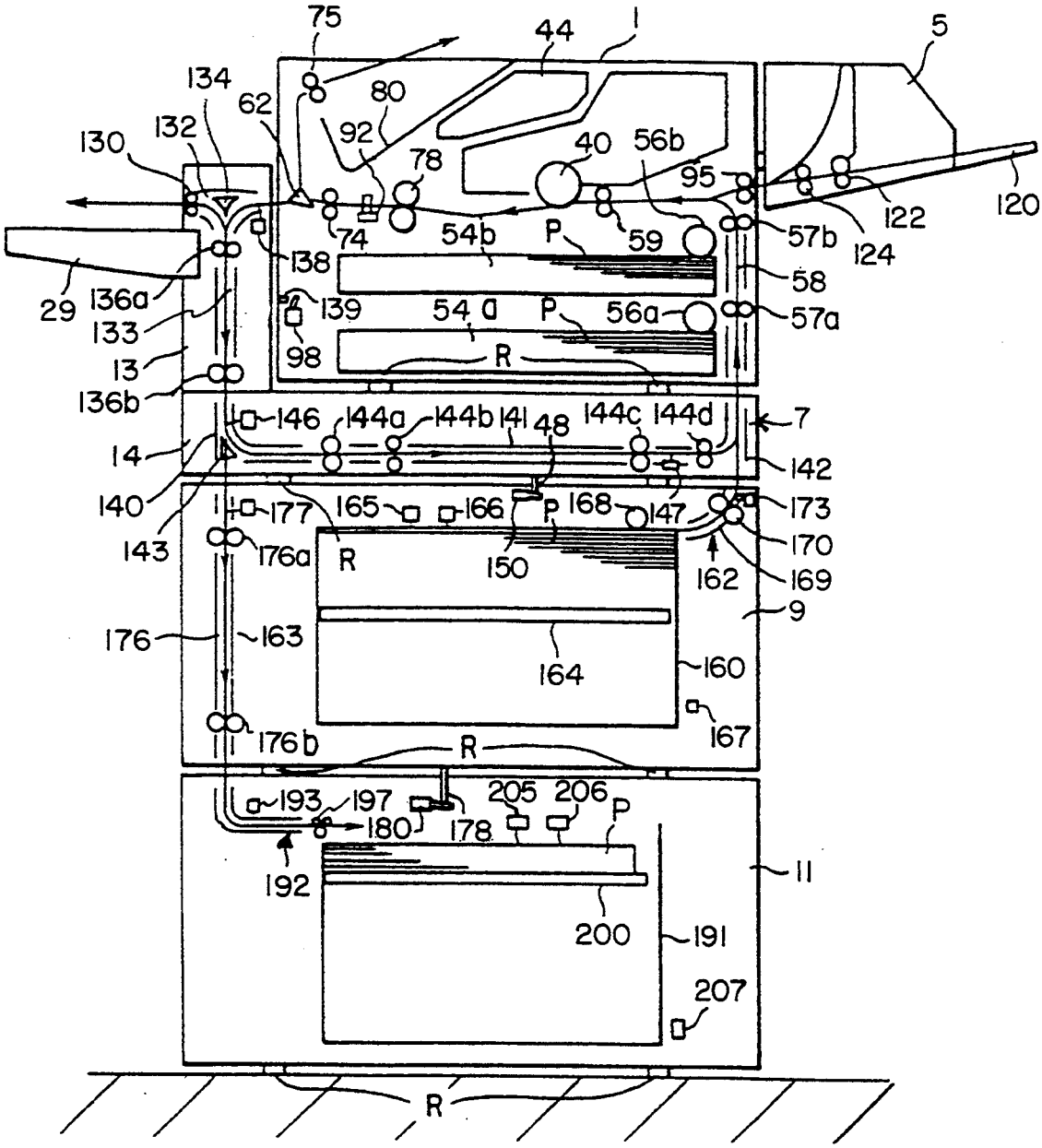
FIG. 2 is a sectional view of the image forming system shown in FIG. 1.

As shown in FIG. 2, MPF 5 is connected to the right-upper side of laser printer 1. Paper-reversing section 13 is connected to the left side of laser printer 1. Paper-feeding section 14 is connected to the bottom of laser printer 1. LCF 9 is connected to the bottom of paper-feeding section 14. LCS 11 is connected to the bottom of LCF 9. Each of laser printer 1, MPF 5, paper-reversing section 13, paper-feeding section 14, LCF 9 and LCS 11 have two parallel rails on the bottom. Due to these rails, each device is correctly positioned when mounted on the immediately lower component.

A sheet tray 29 is connected to paper-reversing section 13, for reversing the sheet P fed from laser printer 1, and also the sheet fed from ADD 7.

Figure 3:
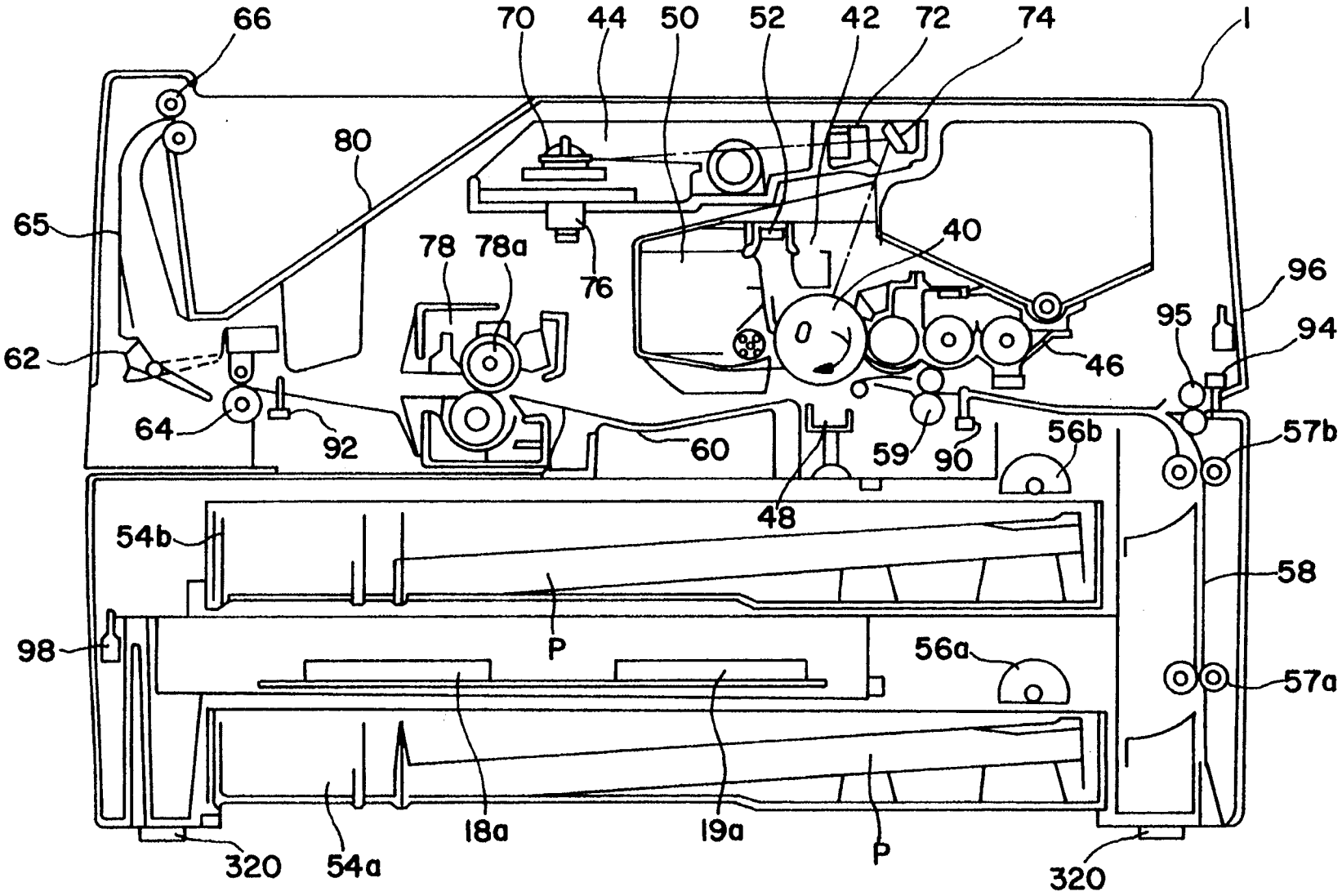
FIG. 3 is a sectional view of a laser printer shown in FIG. 1.

With reference to FIG. 3, laser printer 1 will be described in detail.

Near the middle of laser printer 1 there is provided a drum-shaped photosensitive member 40 rotated in the direction of arrow "a". The surface of photosensitive member 40 is first charged by a charging unit 42. Then, the charged surface of photosensitive member 40 is exposed by a laser optical system 44 so that an electrostatic latent image is formed thereon. The electrostatic latent image is developed by developer particles from a developer unit 46. A developed image is transferred onto the sheet of paper P as a recording medium by a transfer unit 48. After that, the surface of photosensitive member 40 passes a cleaning unit 50 and a discharging lamp 52. Cleaning unit 50 eliminates residual developer particles from the surface of photosensitive member 40. Discharging lamp 52 discharges the surface of photosensitive member 40. On the lower side of laser printer 1, paper cassettes 54*a* and 54*b* which store sheets P. In laser printer 1, a feed path is formed by send-rollers 56*a* and 56*b*, feed-rollers 57*a* and 57*b*, a transport-guide 58, a pair of aligning-rollers 59, a transport-guide 60, a gate 62, a pair of exit-rollers 64, a transport-guide 65 and a pair of exit rollers 66.

Laser optical system 44 includes a semiconductor laser oscillator (not shown) that generates a laser beam, a collimator lens (not shown) that corrects the laser beam from the laser oscillator to form a parallel beam, a polygon mirror 70 is a rotary body having an mirror which reflects the laser beam from the collimator lens for every one scanning line, a f0 lens 72, a mirror 74 and a mirror motor 76 that rotates the polygon mirror 70.

In the image forming operation, the laser beam from laser optical system 44 corresponding to image data supplied from host computer 3 and various operation instructions input from operation panel 16 to printer control section 18 is guided onto the surface of photosensitive member 40 to form the electrostatic latent image. For this condition, photosensitive member 40 is scanned from one end portion to another end portion at a constant speed with the rotation of polygon mirror 70 by mirror motor 76.

On the other hand, sheets P of paper cassette 54*a* or 54*b* is taken out one by one by send-roller 56*a* or 56*b*.

Then sheet P is guided to the pair of aligning-rollers 59 through feed-rollers 57*b* and/or 57*a* and transport-guide 58 and then, sent to transfer unit 48 by a pair of aligning-rollers 59. Sheet P is also supplied to transfer unit 48 from the optional devices, i.e., ADD 7, LCF 9 and LCS 11. Whenever necessary, sheet P is fed from any of the optional devices to aligning-rollers 59 along feed-rollers 57*a* and 57*b* and transport-guide 58, and aligning-rollers 59 feed sheet P to transfer unit 48. After being transferred, sheet P is sent to a fixing unit 78 through transport-guide 60. The transferred image on sheet P is thermally fixed by a pair of fixing rollers 78*a* that generate fixing heat when sheet P passes through fixing unit 78.

Fixing rollers 78*a* house a heater lamp (not shown) for heating. After fixed, paper P is sent to sheet tray 29 or to an exit tray 80. Gate 62 changes between the path in which sheet P is sent to paper-reversing section 13 and the path in which sheet P is sent to exit tray 80. Sheet P is transported by a pair of exit roller 64 when being sent to the paper tray 29. On the other hand, sheet P is transported by a pair of exit roller 66 through transport-guide 65 when being sent to exit tray 80.

In the paper path, an aligning switch 90 is provided in front of the pair of aligning-rollers 59. Aligning switch 90 detects a transportation of sheet P to transfer unit 48 by the aligning rollers 59. An exit switch 92 is provided in front of a pair of exit roller 64. Exit switch 92 detects a transportation of sheet P by the pair of exit roller 54. A transporting detector 94 is provided in front of a pair of transporting roller 95. Transporting detector 94 detects transport of paper P by MPF 5 or manual feeding is provided. A feeder connecting switch 96 is provided near the right-upper side of laser printer 1. Feeder connecting switch 96 detects the connection of MPF 5 to laser printer 1. A reversing unit connecting switch 98 is provided near the left-lower side of laser printer 1. Reversing unit connecting switch 98 detects the connection of paper-reversing section 13 to laser printer 1.

An engine control board 19*a* and a printer control board 18*a* are arranged between paper cassettes 54*a* and 54*b*. Mounted on engine control board 19*a* is engine control section 19 designed to control the electric components contained in the printer 1, so that laser printer 1 accomplishes an image forming process. Mounted on printer control board 18*a* is printer control section 18 designed to control engine control section 19.

Figure 4:
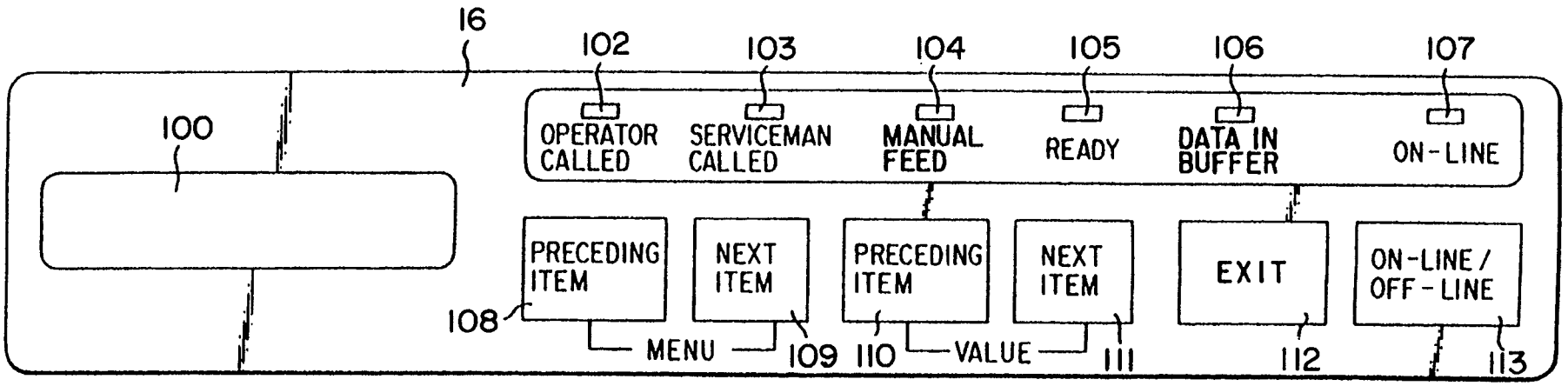
FIG. 4 is a top view of an operation panel of the laser printer shown in FIG. 1.

Operation panel 16 is mounted on the top of laser printer 1. As shown in FIG. 4, operation panel 16 has a liquid-crystal display 100, LED displays 102 to 107, a preceding menu-item key 108, a next menu-item key 109, a preceding value key 110, a next value key 111, an exit key 112 and an on-line key 113.

Liquid-crystal display 100 is designed to display the number of copies to make, the mode in which to operate laser printer 1, various instructions messages, and the like.

LED displays 102–107 each have a Light-Emitting Diode ("LED"), which is turned on to indicate a specific condition in which laser printer 1 is operating. More specifically. The LED of LED display 102 is turned on to call an operator. The LED of LED display 103 is turned on to call a serviceman. The LED of LED display 104 is turned on to ask an operator to feed paper sheet by hand. The LED of LED display 105 is turned on to indicate that laser printer 1 is ready to work. The LED of LED display 106 is turned on to indicate that image data supplied to laser printer 1 is in a buffer memory. The LED of LED display 107 is turned on to indicate that laser printer 1 is in the on-line mode, or is connected to host computer 3. On-line key 113 is operated to set laser printer 1 in on-line mode or off-line mode.

Liquid-crystal display 100 displays various menu items on its left half portion. The menu items are incremented every time next menu-item key 109 is pushed, and are decremented every time preceding menu-item key 108 is pushed. Hence, any menu item is displayed cyclically on liquid-crystal display 100 by depressing preceding menu-item key 108 or next menu-item key 109.

Liquid-crystal display 100 displays on its right half portion the values for the menu items displayed on the left half portion. These values are incremented every time next value key 111 is pushed, and are decremented every time preceding value key 110 is pushed. Thus, the value for any menu item is cyclically displayed on liquid-crystal display 100 by depressing preceding value key 110 and next value key 111.

One of the menu items is the designated paper feeder, i.e., paper cassette 54*a*, paper cassette 54*b*, MPF 5 or LCF 9. Another of the menu items is the designated paper stacker, i.e., sheet tray 29, exit tray 80, LCS 11.

Therefore, the operator can select any operation he or she wants the laser printer 1 to perform, by pushing preceding menu-item key 108, next menu-item key 109, preceding value key 110, and next value key 111—all provided on operation panel 16.

With reference to FIG. 2, MPF 5 will be described.

MPF 5 includes a sheet tray 120, a pickup-roller (not shown), a pair of separating rollers 122, and a pair of aligning rollers 124. The pickup-roller rotates, feeding sheets P placed on sheet tray 120, one after another, to separating rollers 122.

Separating rollers 122 include an upper roller and a lower roller. A torque limiter (not shown) exerts a predetermined load on the upper roller. The lower roller extends parallel to and puts in contact with the upper roller, and drives the upper roller. Separating rollers 122 separate sheets P, one by one, from the other sheets P supplied by the pickup roller, and to each feed sheet P to aligning rollers 124. Aligning rollers 124 first align sheet P and then supply sheet P into laser printer 1. Sheet P is fed farther into laser printer 1 by means of transporting rollers 95 which are located within the housing of laser printer 1.

With reference to FIG. 2, ADD 7, which includes paper-reversing section 13 and paper-feeding section 14, will be described in detail.

Paper-reversing section 13 includes a pair of paper-discharging rollers 130, a first paper passage 132, a second paper passage 133 and a sorting gate 134.

First sheet guide 132 guides sheet P to paper-discharging rollers 130 from gate 62 of laser printer 1. Second sheet guide 133 guides sheet P to paper-feeding section 14 with a pair of transporting rollers 136*a* and 136*b*. Sorting gate 134 guides sheet P into either a first path formed by first sheet guide 132 or a second path formed by second sheet guide 133.

In operation, sheet P discharged through gate 62 of laser printer 1 is guided through the first path to sorting gate 134. Sorting gate 134 guides sheet P to paper-discharging rollers 130 or into the second path. Sheet P guided to paper-discharging rollers 130 is discharged onto sheet tray 29 by paper-discharging rollers 130 rotating in a forward direction, or is guided toward sheet tray 29 for the distance equal to the sheet length by paper-discharging rollers 130 rotating in a forward direction and then back to sorting gate 134 by paper-discharging rollers 130 rotating in a reverse direction. Sheet P, thus supplied to sorting gate 134, is guided into the second path and fed downward into paper-feeding section 14.

A sensor 138 is located at the entrance to the first path, for detecting the supply of sheet P from laser printer 1 into the first path of paper-reversing section 13.

A projection 139 protrudes from the right side of paper-reversing section 13. When paper-reversing section 13 is connected to laser printer 1, projection 139 pushes reversing unit connecting switch 98 secured within laser printer 1. As a result, reversing unit connecting switch 98 detects that paper-reversing section 13 is connected to laser printer 1.

As shown in FIG. 2, paper-feeding section 14 includes a first guide 140, a second guide 141, a third guide 142 and a sorting gate 143. First sheet guide 40 guides sheet P downwards from paper-reversing section 13 into LCF 9. Second sheet guide 141 branches from first sheet guide 140, for guiding sheet P horizontally to third sheet guide 142. Third sheet guide 142 is connected to second sheet guide 141, for guiding upwards sheet P from second sheet guide 141 or from LCF 9 into laser printer 1. Sorting gate 143 guides sheet P supplied from paper-reversing section 13 into LCF 9 through first sheet guide 140 or into second sheet guide 141. Four pairs of transporting rollers 144*a*, 144*b*, 144*c* and 144*d* are arranged along second sheet guide 141.

In operation, sheet P fed from paper-reversing section 13 is guided through first sheet guide 140 to sorting gate 143. Sorting gate 143 guides sheet P into either LCF 9 or second sheet guide 141. Sheet P guided into second sheet guide 141 is fed into transport-guide 58 of laser printer 1 transporting rollers 144*a*, 144*b*, 144*c* and 144*d*. Sheet P supplied from LCF 9 is fed into transport-guide 58 of laser printer 1 through third sheet guide 142 of paper-feeding section 14.

A sensor 146 is located in the vicinity of the entrance to first sheet guide 140 of paper-feeding section 14. Sensor 146 detects sheet P being supplied from paper-reversing section 13 and passing through first sheet guide 140 of paper-feeding section 14.

A sensor 147 is located between transporting rollers 144c and transporting rollers 144*d*. Sensor 147 detects sheet P which is being fed through second sheet guide 141.

A projection 148 protrudes from the bottom of paper-feeding section 14. An upper device sensor 150, which is a switch, is arranged in the top surface of LCF 9. When paper-feeding section 14 is placed on LCF 9, projection 150 turns on sensor 150, which detects that paper-feeding section 14 has been mounted on LCF 9.

LCF 9 will now be described.

LCF 9 includes a storage section 160 for storing sheet P, a paper-feeding section 162 for feeding sheet P from storage section 160, and a paper-feeding section 163.

Storage section 160 has a platform 164 for holding a stack of sheets P and a lift mechanism (not shown) urging platform 164 to move upward. Storage section 160 is a rectangular box open at the top. Claws (not shown) are slidably mounted on the inner surface of the right-side wall of storage section 160. The lift mechanism always urges platform 164 upwards. Hence, the claws contact the uppermost sheet P of the stack placed on platform 164, for preventing the stack protruding up from the rim of storage section 160.

LCF 9 further includes a paper-empty switch 165, an upper limit switch 166, and a lower limit switch 167. Paper-empty switch 165 is located above storage section 160, for detecting whether or not storage section 160 is empty. Upper limit switch 166 is also arranged above storage section 160, for detecting that the top of sheets P on storage section 160 is in a predetermined portion. Lower limit switch 167 is located outside storage section 160 and at the bottom thereof, for detecting that platform 164 is at the lowest position in storage section 160.

When upper limit switch 166 is turned on, an elevator motor (not shown) is driven in the forward direction for a fixed time. The elevator motor drives the lift mechanism so that platform 164 is lifted. When the last sheet P is fed from storage section 160, paper-empty switch 165 is turned on, and the elevator motor is driven in the reverse direction so that platform 164 is lowered. When platform 164 reaches the lowest position, lower limit switch 167 is turned on, and the elevator motor is stopped so that platform 164 stops at the lowest position in storage section 160.

As shown in FIG. 2, paper-feeding section 162 of LCF 9 includes a paper-feeding roller 168, a paper guide 159, a pair of aligning rollers 170, a pre-feeding sensor 173, and a motor. A pulley (not shown) is coaxially connected to paper-feeding roller 168, and a pulley (not shown) is secured to the shaft of the motor. An endless bolt (not shown) is wrapped around these pulleys. Paper guide 169 and aligning rollers 170 constitute a paper path which extends from the right rim of storage section 160 to third sheet guide 142 of paper-feeding section 14. When driven by the motor (not shown), paper-feeding roller 168 feeds the uppermost sheet P from storage section 160 into paper guide 169. Sheet P is supplied through paper guide 169 as aligning rollers 170 are rotated. Sensor 173 detects sheet P as sheet P moves into third sheet guide 142 of paper-feeding 14.

Paper-feeding section 163 includes a paper guide 176, a pair of paper-feeding rollers 176*a* and 176*b*, and a sensor 177 located near paper-feeding rollers 176*a*. Paper guide 176 extends vertically, and paper-feeding section 163 feeds sheet P downward from first sheet guide 140 of paper-feeding section 14 to LCS 11. Sensor 177 detects any sheet P supplied into paper guide 176 from first sheet guide 140 of paper-feeding section 14.

Upper device sensor 150 is located above first lift switch 166. When pushed by projection 148, sensor 150 is turned on and generates a signal so as to be capable of detecting that the paper-feeding section 4 is mounted on LCF 9 even if a power-supply switch of paper-feeding section 14 is off.

A projection 178 protrudes downwards from the bottom of LCF 9. Projection 178 is used to turn on an upper device sensor 180 provided in LCS 11.

Figure 5:
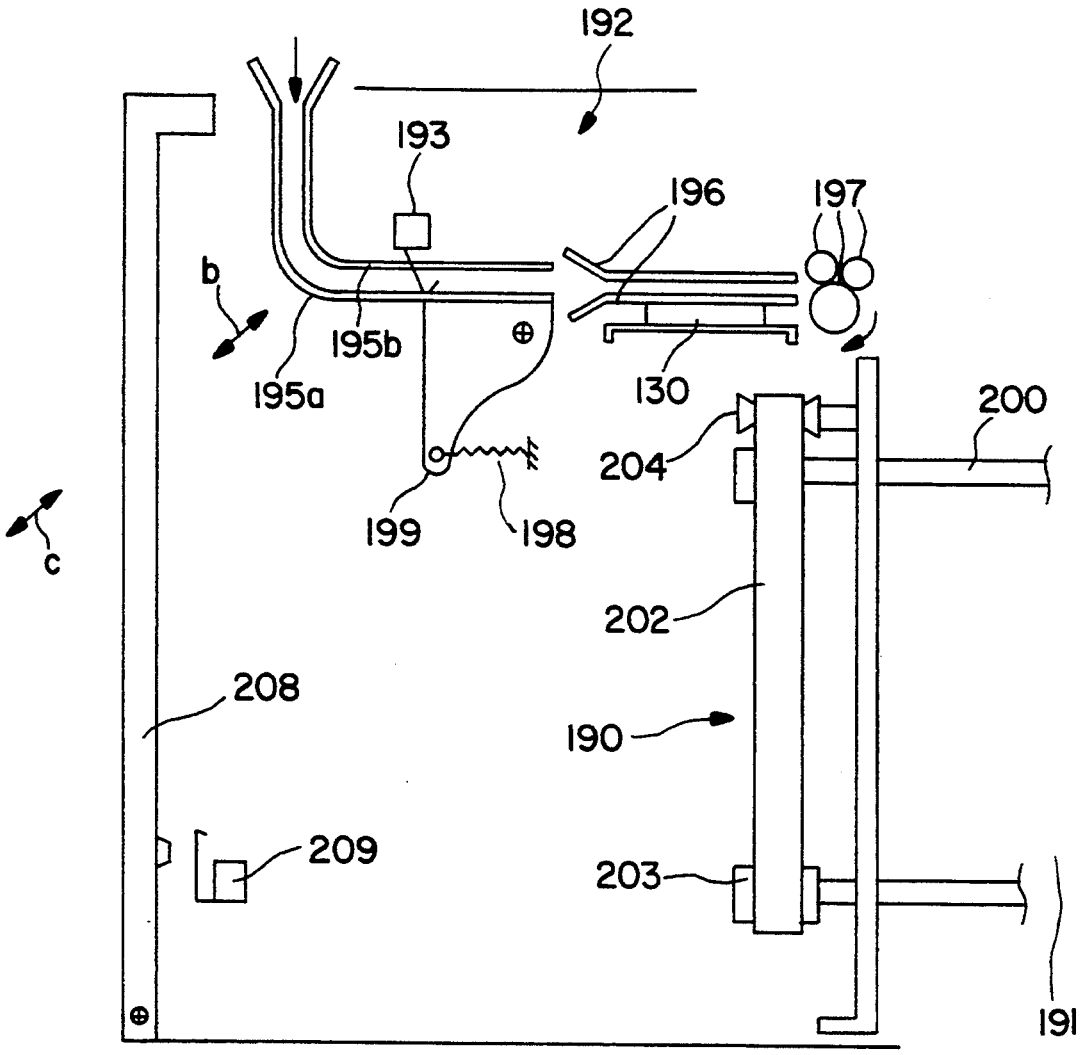
FIG. 5 is a local sectional view of a large-capacity stacker shown in FIG. 1.

LCS 11 will be described in detail, referencing FIGS. 2, 5 and 6.

LCS 11 includes an elevator mechanism 190, a storage section 191 for storing sheet P transported, a paper-feeding section 192 and a sensor 193. Elevator mechanism 190 and paper-feeding section 192 cooperate to stack sheet P in storage section 191.

Sheet P is fed from an upper device, for instance, the paper guide 176 of LCF 9 is transported to storage section 191 through paper guides 195*a* and 195*b* and 196 and exit rollers 197. Sensor 193 provided near paper guides 195*a* and 195*b* detects the transportation of sheet P fed through paper guides 195*a* and 195*b*.

Paper guide 195*a* is swingably mounted, and is capable of rotating itself in the direction of arrow "b" and returning to an original position by a spring 198 connected to a plate 199 fixed to paper guide 195*a*.

In storage section 191, an elevator table 200 on which sheet P is stacked is provided. Elevator table 200 is moved upward/downward by an elevator mechanism 190 that is composed of a belt 202 connected to and driven by a motor, a take-up roller 203, and a idle roller 204, etc.

Elevator table 200 has a convex part. If curled sheet P is placed on elevator table 200, the central part of sheet P is lifted up by the convex part and sheet P becomes almost the horizontal state so that the number of sheets to be stacked is increased. The convex part is in the gentle convex shape to prevent the paper from being jammed.

A paper empty sensor 205 and an upper limit switch 206 are arranged on the top of storage section 191. A lower limit switch 207 is located outside storage section 191 and at the bottom thereof. Paper-empty sensor 205 detects that there is sheet P in storage section 191. Upper limit switch 206 detects that elevator table 200 is not in the sheet P stackable state and elevator table 200 must be moved downward by tile specified quantity. Lower limit switch 207 detects that elevator table 200 reaches the lower limit position, that is, storage section 191 closes by a sheet full condition. After the detection of lower limit switch 207, elevator table 200 permits to receive only ten sheets P. When limit switch 207 is turned on, the stacker to which sheet P is transported is automatically changed from LCS 11 to exit tray 80.

When several sheets P are stacked and upper limit switch 206 is turned on, elevator table 200 is moved downward while the motor is turned on for a fixed time or until upper limit switch 206 is turned off.

LCS 11 includes a side-cover 208 and a side-cover switch 209 which is provided near the side-cover 208. When side-cover 208 is opened in the direction of arrow "c", the operator is permitted to access paper guide 195a. For this condition, side-cover switch 209 is turned OFF, then the image forming operation of laser printer 1 is stopped immediately.

Figure 6:
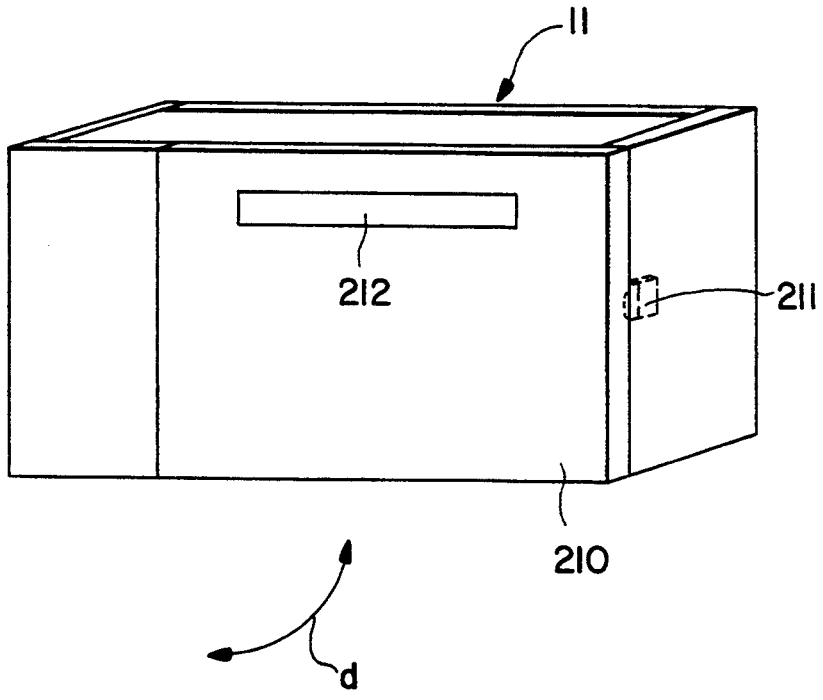
FIG. 6 is a perspective view of the large-capacity stacker shown in FIG. 1.

As shown in FIG. 6, a front-cover 210 is provided on the front side of LCS 11 and openably in the direction of arrow "d". A front-cover switch 211 is provided near front-cover 210 and in the inside of LCS 11. Front-cover switch 211 detects the opening of front-cover 210. A handle 212 for handling is arranged in front-cover 210. When front-cover 210 is opened, the operator is permitted to take away sheet P stacked on elevator table 200. For this condition, front-cover switch 211 is turned OFF, then the stacker to which sheet P is transported is automatically changed from LCS 11 to exit tray 80.

Upper device sensor 180 is located above storage section 191. Upper device sensor 180 is turned on by projection 178 LCF 9 when LCF 9 is mounted on LCS 11. When upper device sensor 180 is turned on, upper device sensor 180 generates a signal so as to be capable of detecting that LCF 9 is placed on LCS 11 even if the power-supply switch of LCF 9 is OFF. Upper device sensor 180 is so positioned that it is not turned on by projection 48 even if paper-feeding section 14 is mounted on LCS 11.

Figure 7:
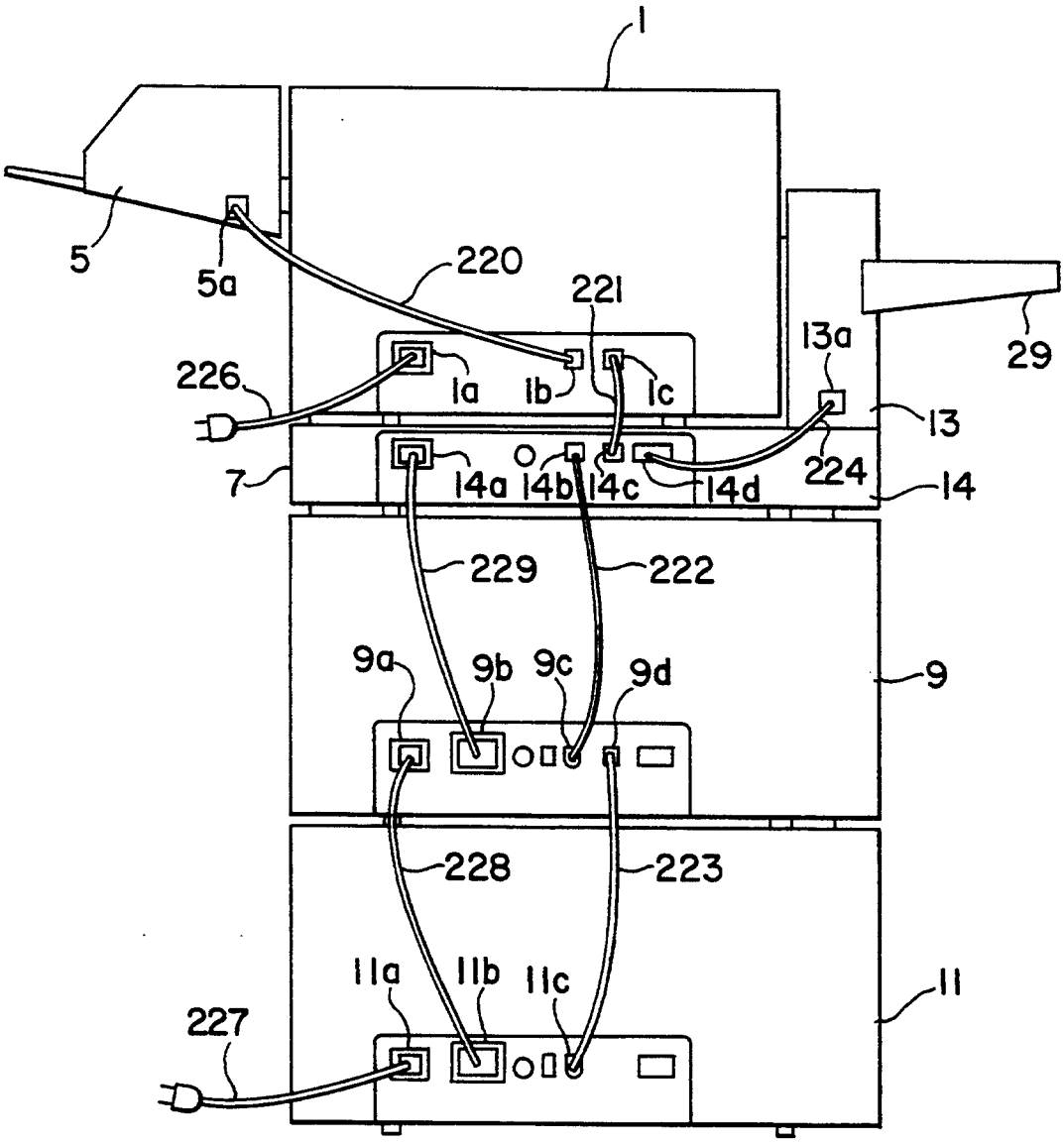
FIG. 7 is a rear wiring diagram showing a wiring of the image forming system shown in FIG. 1.

As shown in FIGS. 1 and 7, laser printer 1 and the optional devices are connected by means of connectors and cables. To be more specific, a cable 220 connects an I/F connector 1*b* of laser printer 1 to an I/F connector 5*a* of MPF 5. A cable 221 connects an I/F connector 1*c* of laser printer 1 to an I/F connector 14*c* of paper-feeding section 14. A cable 222 connects an I/F connector 14*b* of paper-feeding section 14 to an I/F connector 9*c* of LCF 9. A cable 223 connects an I/F 9*d* of LCF 9 to an I/F connector 11*c* of LCS 11. A cable 224 connects an I/F connector 14*d* of paper-feeding section 14 to an I/F connector 13*a* of paper-reversing section 13.

Power source inlets 1*a* and 7*a* are connected to external receptacles through power cables 226 and 227. A power inlet 9*a* and a power outlet 7*b* are connected with a power cable 228 so that the power is supplied to LCF 9 through power cable 228. A power inlet 14*a* and a power outlet 9*b* are connected with a power cable 229 so that the power is supplied to ADD 7 through power cable 229.

Figure 8:
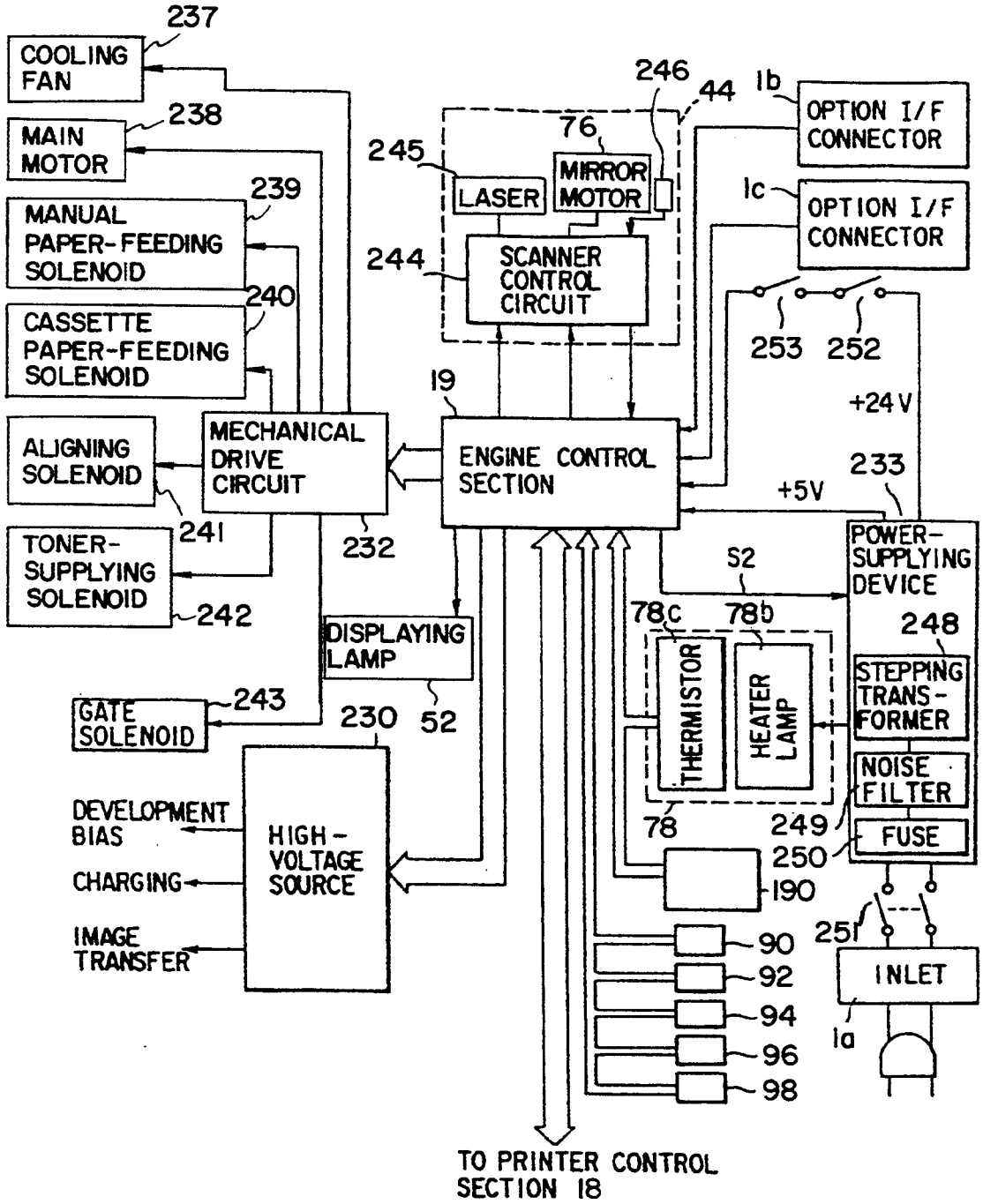
FIG. 8 is a block diagram showing the major components of an engine control section of the laser printer shown in FIG. 1.

Referring to FIG.8, engine control section 19 in laser printer 1 will now be described.

Coupled to engine control section 19 are: laser optical system 44, discharging lamp 52, fixing unit 78, aligning switch 90, exit switch 92, transporting detector 94, feeder connecting switch 96, reversing unit connecting switch 98, I/F connectors 1*b* and 1*c*, a high voltage source 230, a mechanism drive circuit 232, and a power-supplying device 233.

Engine control section 19 has a memory (not shown) which stores a table used for determining whether each optional device is correctly connected to laser printer 1.

High-voltage source 230 supplies a development bias voltage to developer unit 46, a charging voltage to charging unit 42, and a transfer voltage to transfer unit 48.

Mechanical drive circuit 232 is designed to drive motors and solenoids. Coupled to mechanical derive circuit 232 are: a cooling fan 237 for cooling the air in laser printer 1, a main motor 238 for rotating photosensitive member 40 and several rollers, a manual paper-feeding solenoid 239,a cassette paper-feeding solenoid 240, an aligning solenoid 241, a toner-supplying solenoid 242 and a gate solenoid 243.

When manual paper-feeding solenoid 239 is excited, the rotation of main motor 238 is transmitted to the pair of transporting rollers 95. When cassette paper-feeding solenoid 240 is excited, the rotation of main motor 238 is transmitted to either send-roller 56*a* or 56*b* so that either send-roller 56*a* or 56*b* is rotated.

When aligning solenoid 241 is excited, the rotation of main motor 238 is transmitted to aligning-rollers 59 so that aligning rollers 59 are rotated. When toner-supplying solenoid 242 is excited, the rotation of main motor 238 is transmitted to a toner-supplying roller (not shown) incorporated in developer unit 46. When gate solenoid 243 is excited, gate 62 is turned so that sheet P is guided to exit tray 80.

Laser optical system 44 includes a scanner control circuit 244. Scanner control circuit 244 is connected to semiconductor laser oscillator 245, a laser-beam sensor 246 and the mirror motor 76, and scanner control circuit 244 controls semiconductor laser oscillator 245, laser-beam sensor 246 and mirror motor 76.

Fixing unit 78 has fixing rollers 78a, a heater lamp 78b contained in fixing rollers 78*a*, and a thermistor 78*c* located near fixing rollers 78*a* to detect the temperature therearound.

Power-supplying device 233 includes a stepping transformer 248, a noise filter 249 coupled to stepping transformer 248, a fuse 250 coupled to noise filter 249. Stepping transformer 248 is coupled to power source inlet 1a through by noise filter 249, fuse 250, and a main switch 251.

When main switch 251 is turned on, power-supplying device 233 outputs a power-supply voltage of +5 V and a power-supply voltage of +24 V. The voltage of +5 V is applied to engine control section 19 and to printer control section 18. The voltage of +24 V is applied to a cover switch 252 and to a cover switch 253, and finally to engine control section 19. The voltage of +24 V is applied from engine control section 19 to scanner control circuit 244, the high-voltage source 230 and mechanism drive circuit 232.

Scanner control circuit 244 applies the voltage of +25 V to semiconductor laser oscillater 245 and mirror motor 76. Mechanism drive circuit 232 applies the voltage of +25 V to discharging lamp 52, main motor 238, manual paper-feeding solenoid 239, cassette paper-feeding solenoid 240, aligning solenoid 241, toner-supplying solenoid 242, gate solenoid 243, and cooling fan 237 so as to drive these components 177, 178, 179, 180, 181, 182, 183, and 191.

Power-supplying device 233 further includes a lamp drive circuit (not shown) for driving heater lamp 78b of fixing unit 78.

Engine control section 19 supplies a heater control signal to power-supplying device 233. Thermistor 78c generates a signal representing the temperature in fixing unit 17. The heater control signal is supplied to engine control section 19.

Cover switch 252 is turned off when the top of a cover (not shown) of laser printer 1 is rotated upward to an opened position. Cover switch 253 is turned off when a rear cover (not shown) of laser printer 1 is opened. Hence, when the top cover or the rear cover, or beth are opened, the supply of the +24 voltage to engine control section 19 is stopped so that semiconductor laser oscillater 245, mirror motor 76, high-voltage source 230, main motor 238, manual paper-feeding solenoid 239, cassette paper-feeding solenoid 240, aligning solenoid 241, toner-supplying solenoid 242, gate solenoid 243, cooling fan 237 and heater lamp 78b fail to actuate. Hence, the operator is permitted to have an access into laser printer 1, without danger.

Figure 9:
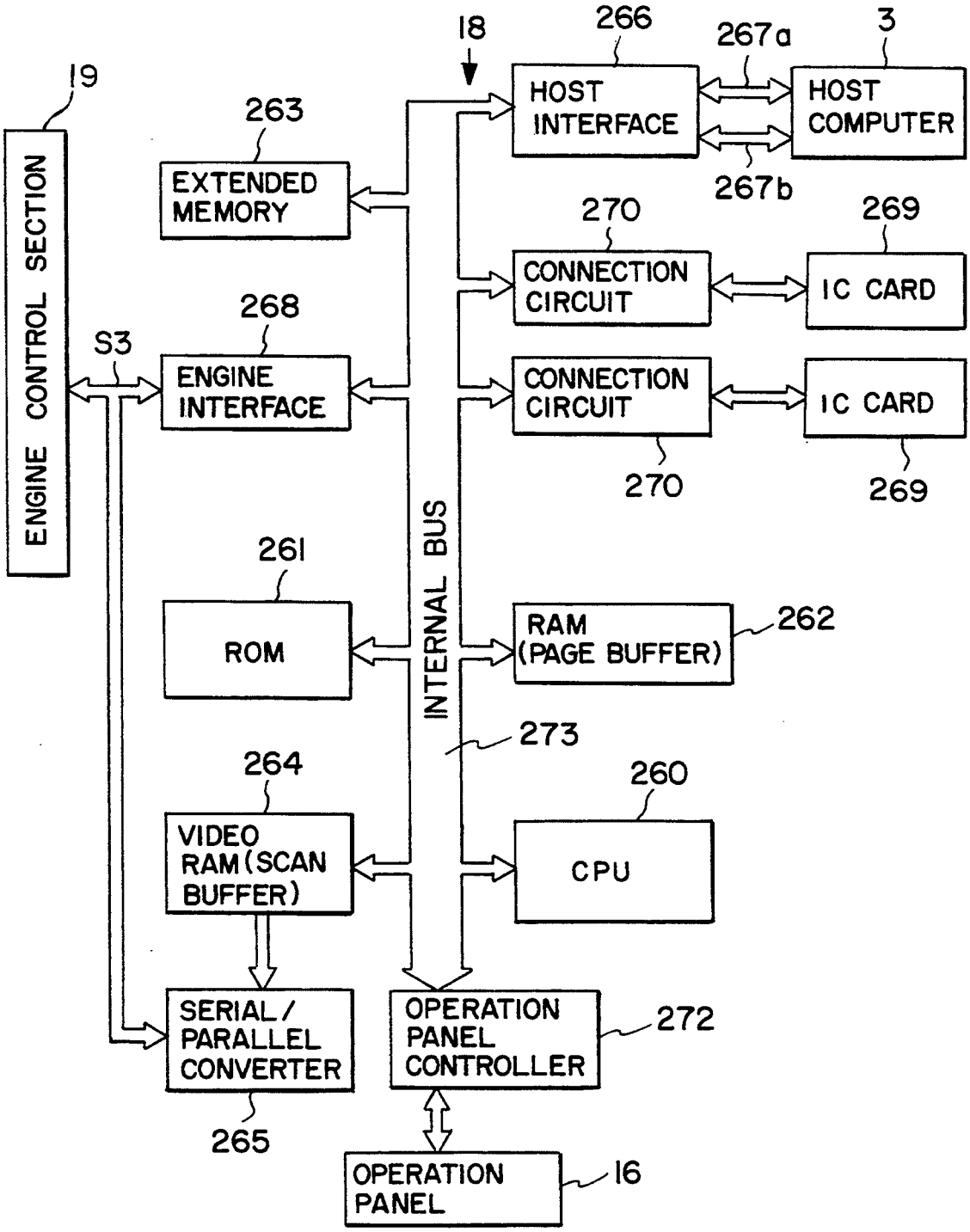
FIG. 9 is a block diagram showing the major components of a printer control section of the laser printer shown in FIG. 1.

Referring to FIG. 9, the arrangement of printer control section 18 will be described. A CPU 260 controls the entire printer control section 18. A ROM 261 stores control programs, and CPU 260 operates in accordance with the programs stored by ROM 261. ROM 261 also stores data concerning sheet P, such as a password which is collated upon data updating, a top margin, a left margin, and a paper type and message information to be informed to an operator. A RAM 262 is used as a page buffer for temporarily storing image data of a plurality of pages supplied from host computer 3.

An extended memory 263 is a large-capacity memory used when the image data supplied from host computer 3 is a large amount of data such as bit map data and RAM 262 fails to store data of one page. A video RAM 264 stores the image data developed into bit image data and supplies an output to a serial-parallel converter 265. Serial-parallel converter 265 converts parallel bit image data into serial image data and supplies serial image data to engine control section 19.

A host interface 266 includes two types of transfer lines, i.e., a serial transfer line 267a and a parallel transfer line 267b for performing a data exchange between host computer 3 and printer control section 18. Two transfer lines 267a and 267b are alternatively used in accordance with the type of data transferred from host computer 3.

An engine interface 268 intermediates exchange of an interface signal S3 between printer control section 18 and engine control section 19. When an IC card 269 is connected to or disconnected from a connector (not shown), a connection circuit 270 interrupts a power source voltage supplied to IC card 269 so as to prevent data stored in IC card 269 from being destroyed by noise generated upon connection/disconnection of IC card 269.

An operation panel controller 272 performs control for displaying a guide message on liquid-crystal display 100 of operation panel 16, control for turning on/off or flashing LED displays 102–107, and control for supplying data input from keys 108–113 to CPU 260. An internal bus 273 is used in data exchange among CPU 260, ROM 261, RAM 262, extended memory 263, video RAM 264, operation panel controller 272, host interface 266, engine interface 268, and connection circuit 270.

Figure 10:
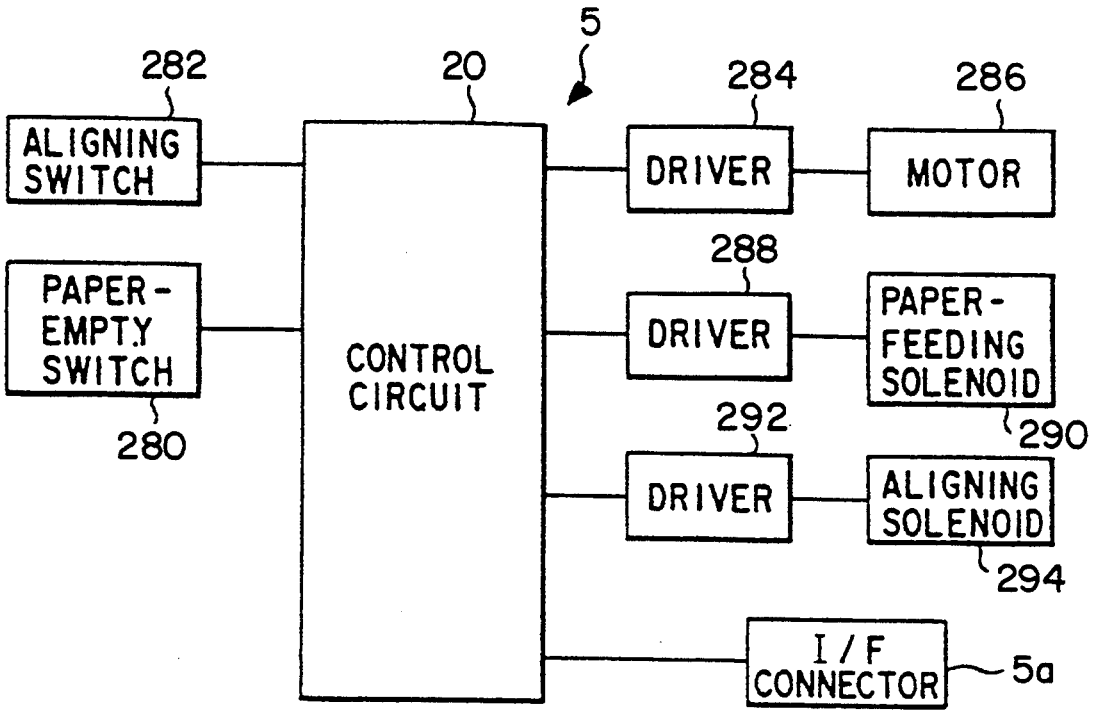
FIG. 10 is a block diagram showing the major components of a multi paper feeder shown in FIG. 1.

Control circuit 20 provided in MPF 5 will be described, with reference to FIG. 10. Coupled to control circuit 20 are: a paper-empty switch 280, an aligning switch 282, I/F connector 5a, a driver 284 for driving a motor 286, a driver 288 for driving a paper-feeding solenoid 290, and a driver 292 for driving an aligning solenoid 294.

Paper-empty switch 280 detects the absence of sheet P on sheet tray 120. Aligning switch 282 is arranged near aligning rollers 124 and detects sheet P transported by separating rollers 122. Motor 286 rotates separating rollers 122 and aligning rollers 124. When paper-feeding solenoid 290 is excited, the rotation of motor 286 is transmitted to separating rollers 122 so that separating rollers 122 are rotated. When aligning solenoid 294 is excited, the rotation of motor 286 is transmitted to aligning rollers 124 so that aligning rollers 124 are rotated. Control circuit 20 transmits a driving signal to drivers 288 and 292 so that the actuation of paper-feeding solenoid 290 and aligning solenoid 294 synchronize with the actuation of laser printer 1.

Figure 11:
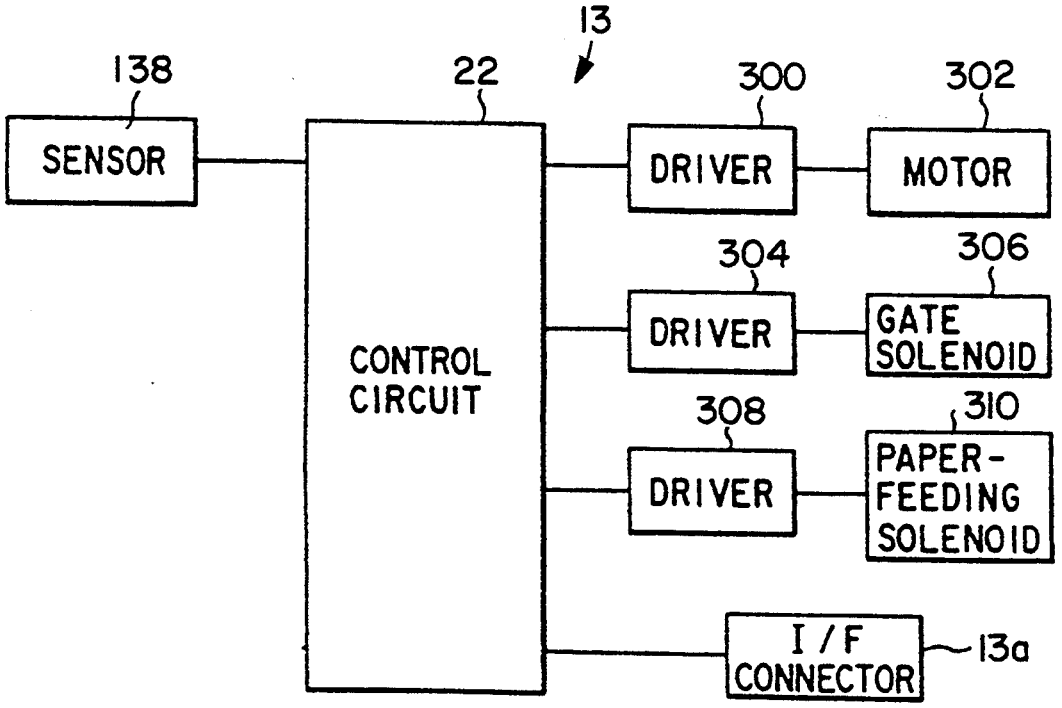
FIG. 11 is a block diagram showing the major components of a paper-reversing section of an automatic duplexer device shown in FIG. 1.

Control circuit 22 provided in paper-reversing section 13 will be described, with reference to FIG. 11. Coupled to control circuit 22 are: sensor 138, I/F connector 13a, a driver 204 for driving a motor 302, a driver 304 for exciting a gate solenoid 306, and a driver 308 for exciting a paper-feeding solenoid 310. When gate solenoid 306 is excited, sorting gate 134 is turned. When paper-feeding solenoid 310 is excited, the rotation of motor 302 is transmitted to paper-discharging rollers 130 and transporting rollers 136a and 136b, so that paper-discharging rollers 130 and transporting rollers 136a and 136b are rotated.

Figure 12:
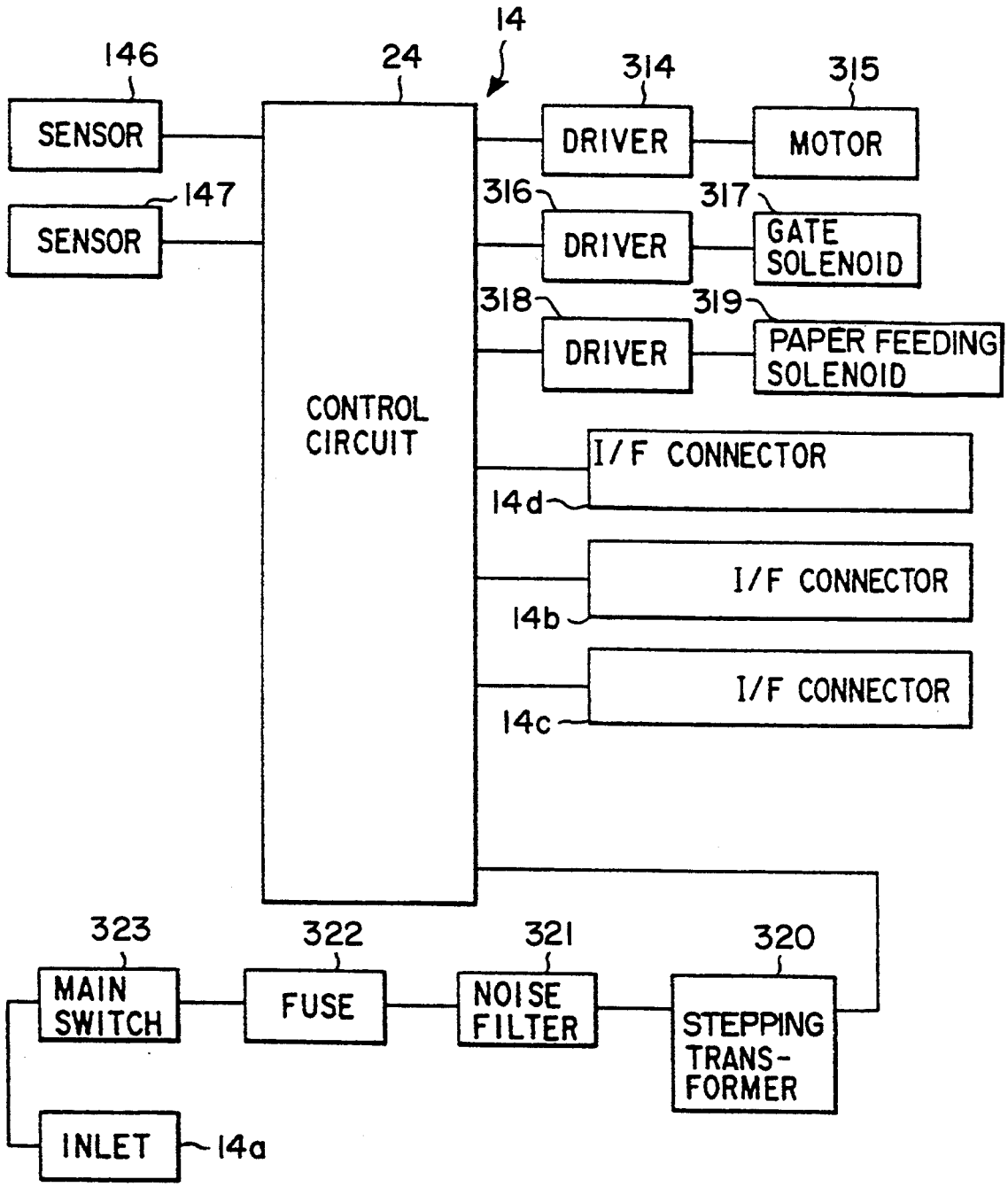
FIG. 12 is a block diagram showing the major components of a paper-feeding section of the automatic duplexer device shown in FIG. 1.

Referring to FIG. 12, control circuit 24 used in paper-feeding section 14 will be described. Coupled to control circuit 24 are: sensor 146 and sensor 147, I/F connector 14d, I/F connector 14b and I/F connector 14c, a driver 314 for driving a motor 315, a driver 316 for exciting a gate solenoid 317, a driver 318 for exciting a paper-feeding solenoid 319, and a stepping transformer 320. Stepping transformer 320 is coupled to a noise filter 321, which is coupled to a fuse 322. Fuse 322 is coupled to a main switch 323, and main switch 323 is coupled to inlet 4a. When main switch 251 is turned on, a power-supply voltage is output to control circuit 24 through inlet 14a, main switch 323, fuse 322, noise filter 321 and stepping transformer 320.

When gate solenoid 317 is excited, sorting gate 143 is turned on. When paper-feeding solenoid 319 is excited, the rotation of motor 315 is transmitted to transporting rollers 144a, 144b, 144c and 144d so that transporting rollers 144a, 144b, 144c and 144d are rotated.

Figure 13:
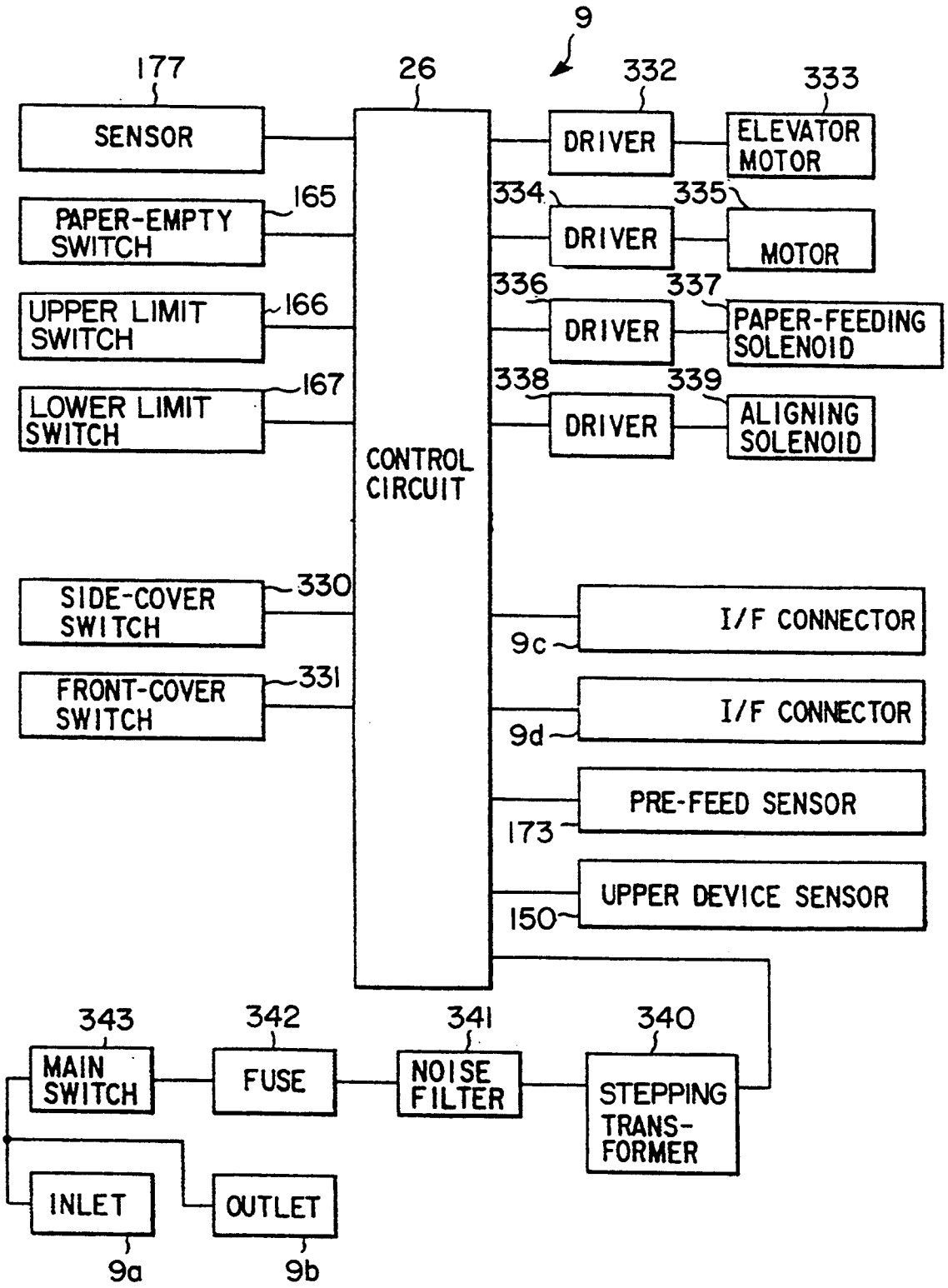
FIG. 13 is a block diagram showing the major components of a large-capacity feeder shown in FIG. 1.

Control circuit 26 used in LCF 9 will be described, with reference to FIG. 13. Coupled to the control circuit 26 are: sensor 177, paper-empty switch 165, upper limit switch 166, lower limit switch 167, I/F connector 9c and I/F connector 9d, a pre-feeding sensor 173, a side-cover switch 330, a front-cover switch 331, upper device sensor 150, a driver 332 for driving elevator motor 333, a driver 334 for driving a motor 335, a driver 336 for exciting a paper-feeding solenoid 337, a driver 338 for exciting an aligning solenoid 339, and a stepping transformer 340. The stepping transformer 340 is coupled to a noise filter 341, which is coupled to a fuse 342. Fuse 342 is coupled to a main switch 343. Main switch 343 is coupled to an inlet 9a and an outlet 9b.

When main switch 343 is turned on, a power-supply voltage is output to control circuit 26 through inlet 9a, main switch 343, fuse 342, noise filter 341 and stepping transformer 340.

When motor 335 is driven, the rotation of motor 335 is automatically transmitted to paper-feeding rollers 176a and 176b. When paper-feeding solenoid 337 is excited, the rotation of motor 335 is transmitted to paper-feeding roller 168 so that paper-feeding roller 168 is rotated. When aligning solenoid 339 is excited, the rotation of the motor 238 is transmitted to aligning rollers 170 so that aligning rollers 170 are rotated.

Figure 14:
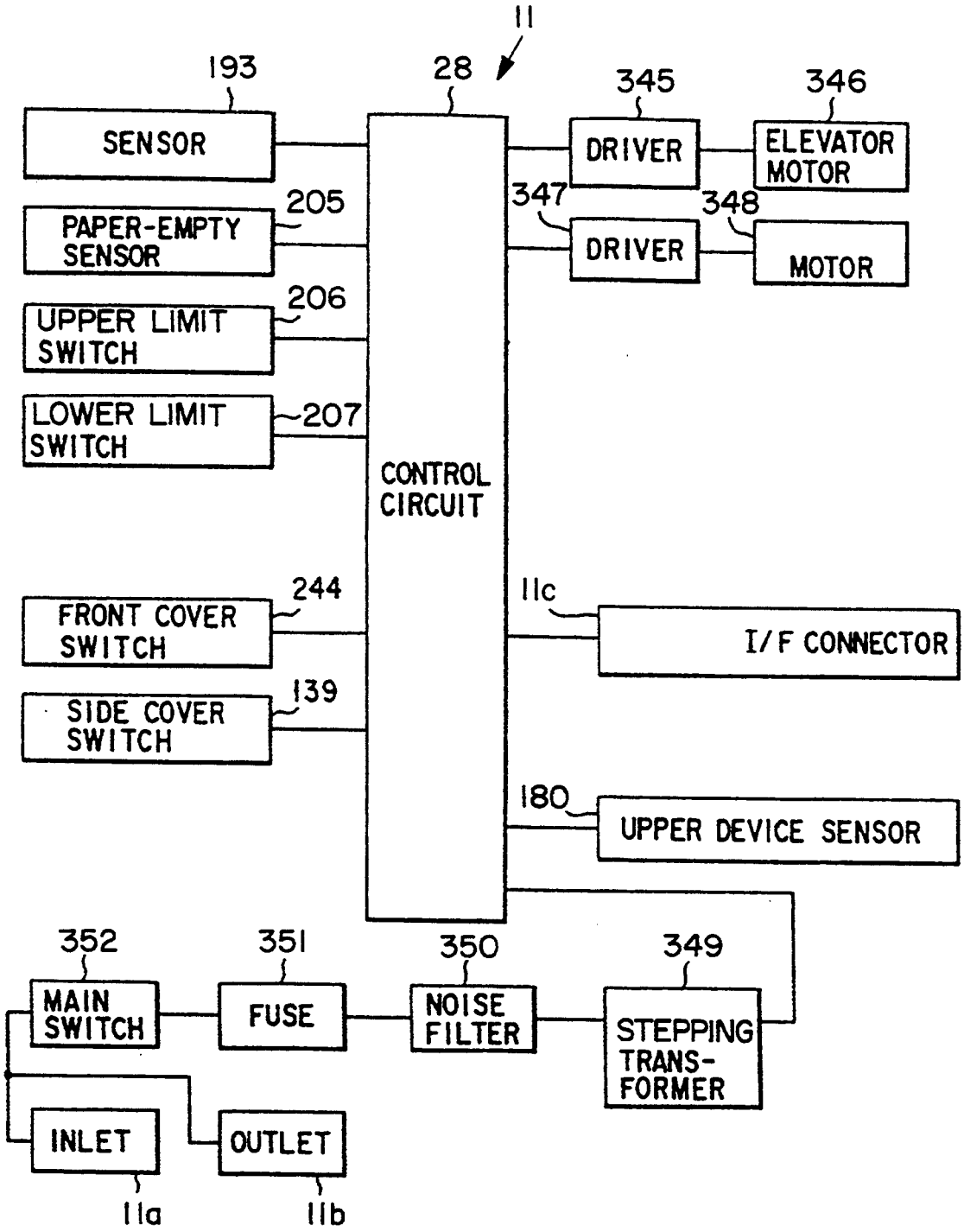
FIG. 14 is a block diagram showing the major components of the large-capacity stacker shown in FIG. 1.

Referring to FIG. 14, control circuit 28 used in LCS 11 will be described. Coupled to control circuit 28 are: sensor 193, paper-empty sensor 205, upper limit switch 206, lower limit switch 207, I/F connector 11c, side-cover switch 209, front-cover switch 211, upper device sensor 180, a driver 345 for driving an elevator motor 346, a driver 347 for driving a motor 348, and a stepping transformer 349. Stepping transformer 349 is coupled to a noise filter 350, which is coupled to a fuse 351. Fuse 351 is coupled to a main switch 352. Main switch 352 is coupled to an inlet 11a and 11b.

When main switch 351 is turned on, a power-supply voltage is output to control circuit 28 through inlet 11a, main switch 352, fuse 351, noise filter 350 and stepping transformer 349.

The rotation of elevator motor 346 is transmitted to elevator mechanism 190 so that elevator table 200 is moved upward or downward.

When motor 348 is driven, the rotation of motor 348 is transmitted to exit rollers 197 so that exit rollers 197 are rotated.

When lower limit switch 207 is turned on, control circuit 28 detects that +CS 11 is approximately full.

When side-cover 208 is opened, side-cover switch 209 is turned off. When front-cover 210 is opened, front-cover switch 211 is turned off. For this condition, control circuit 28 detects the opening condition of side-cover 208 and/or front-cover 210.

Figure 15A:
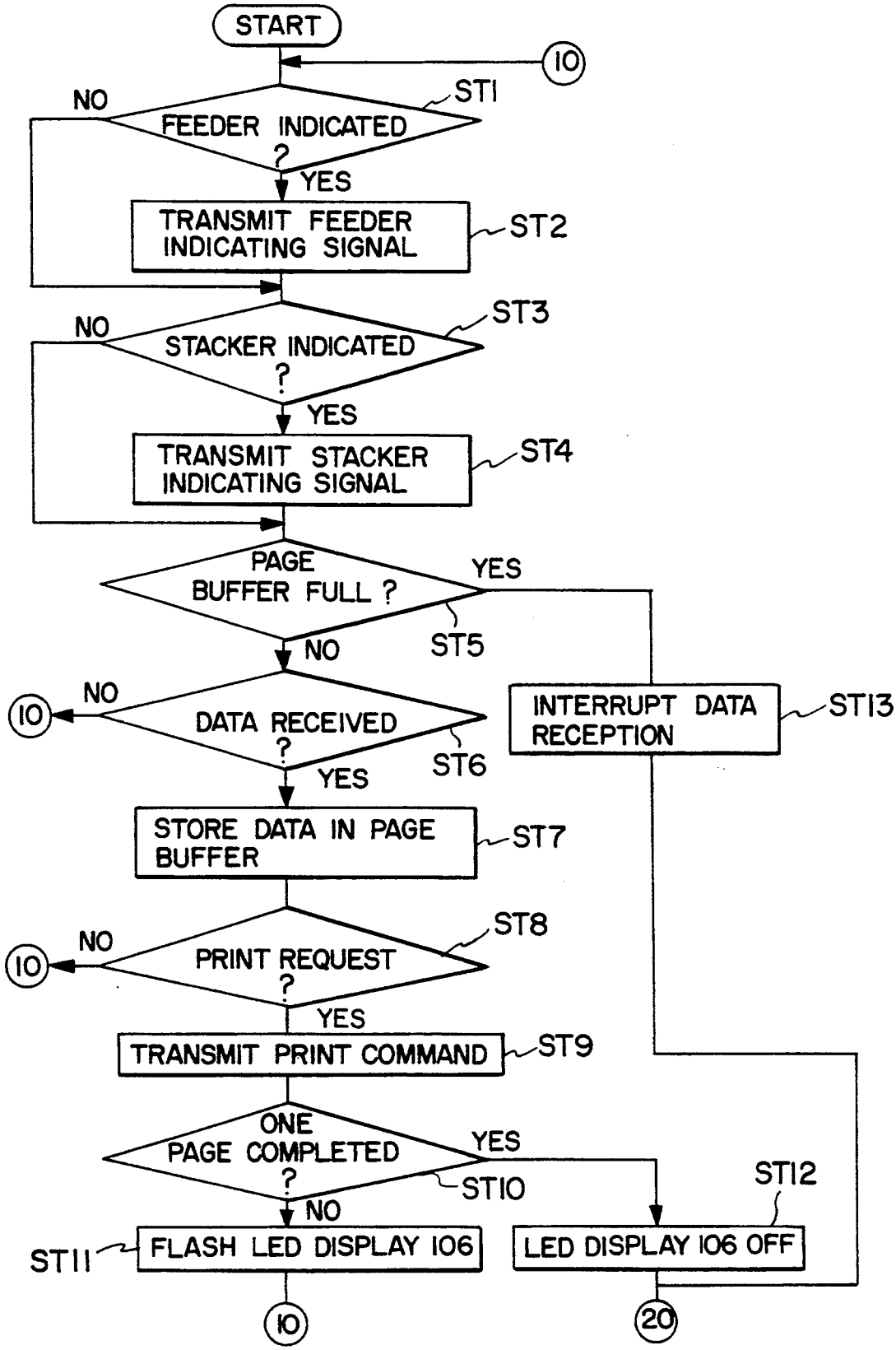
FIGS. 15A and 15B are flowcharts for explaining operations of the printer control section of the laser printer shown in FIG. 1.
Figure 15B:
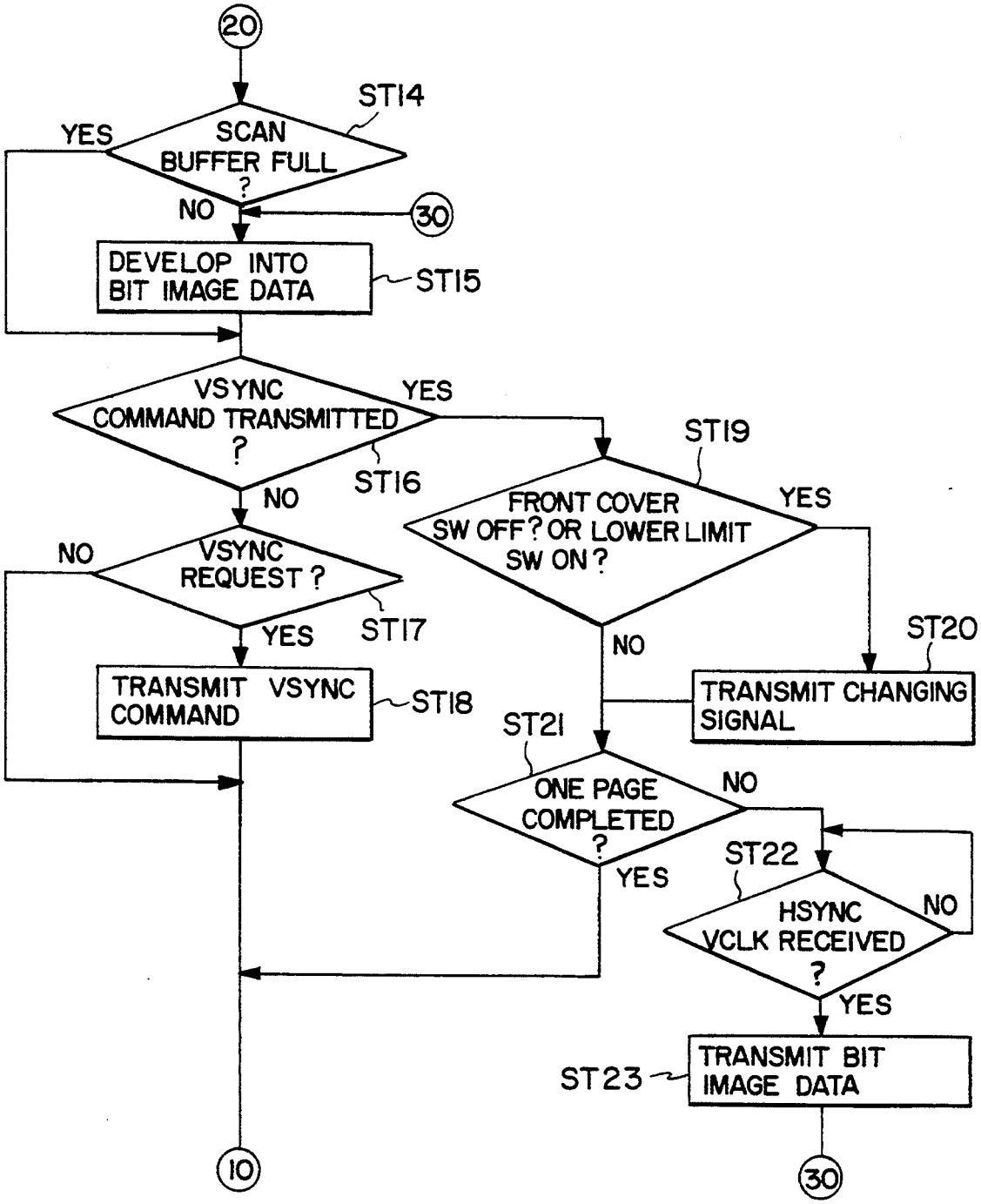
Figure 16A:
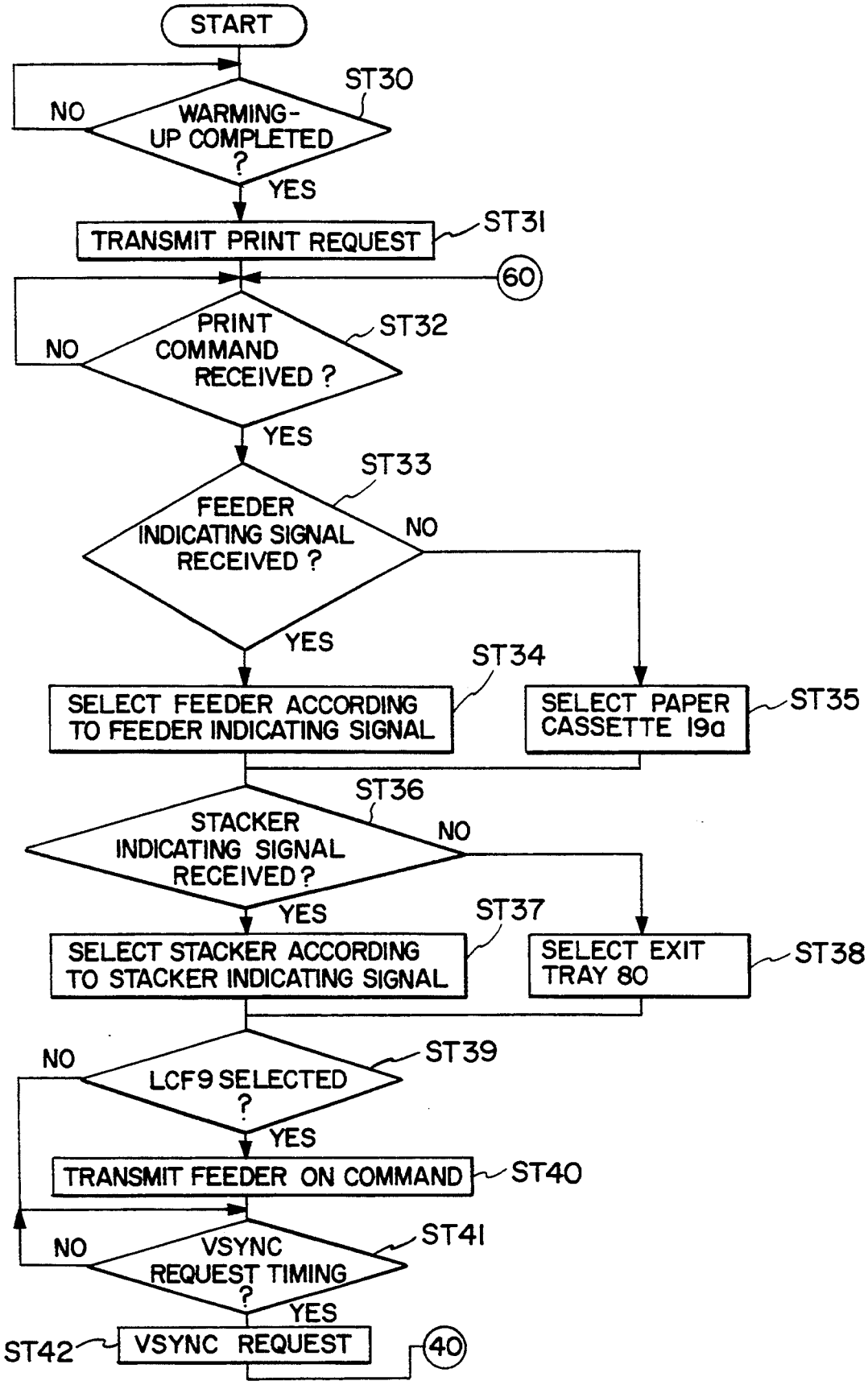
FIGS. 16A, 16B, 16C and 16D are flowcharts for explaining operations of the engine control section of the laser printer shown in FIG. 1.
Figure 16B:
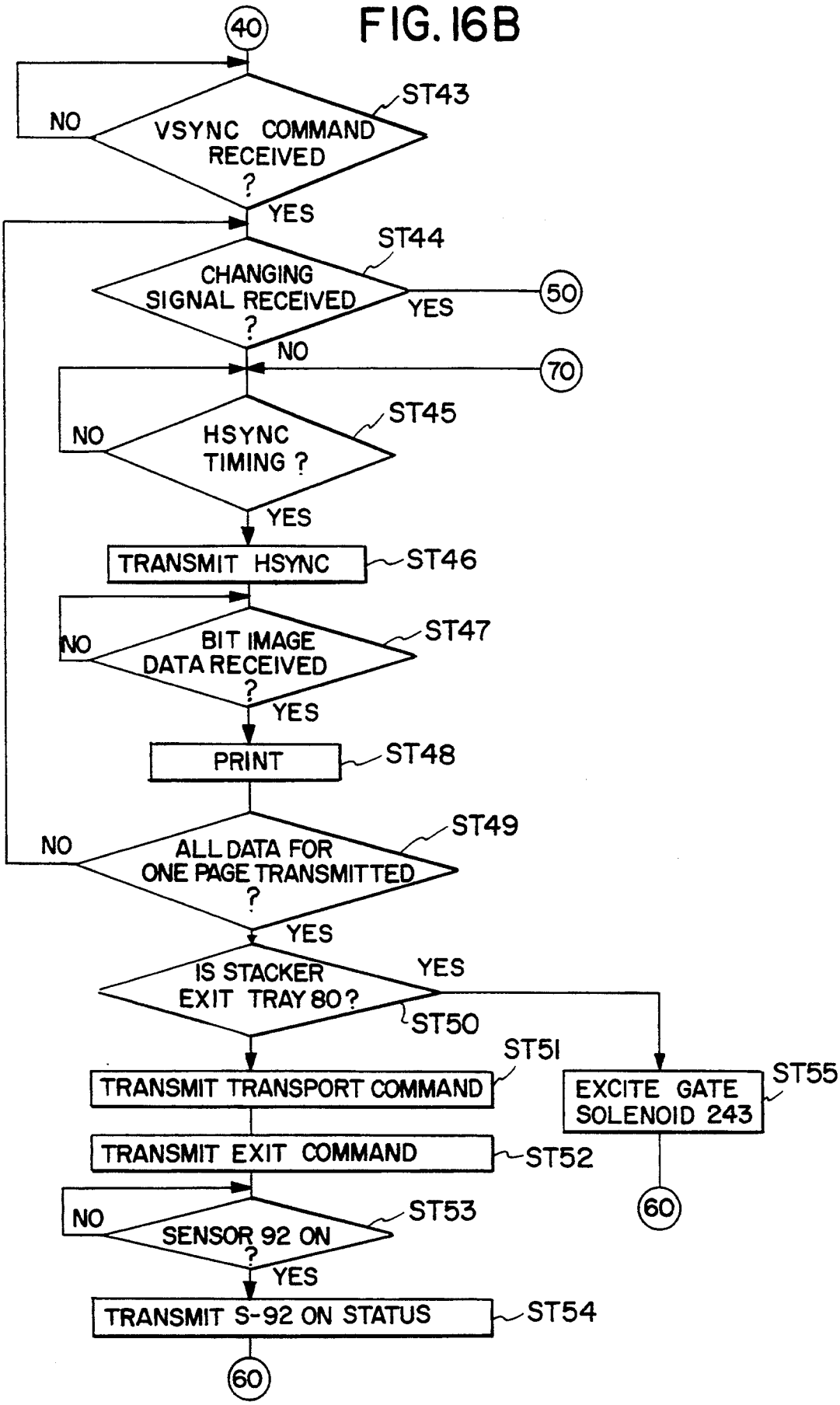
Figure 16C:
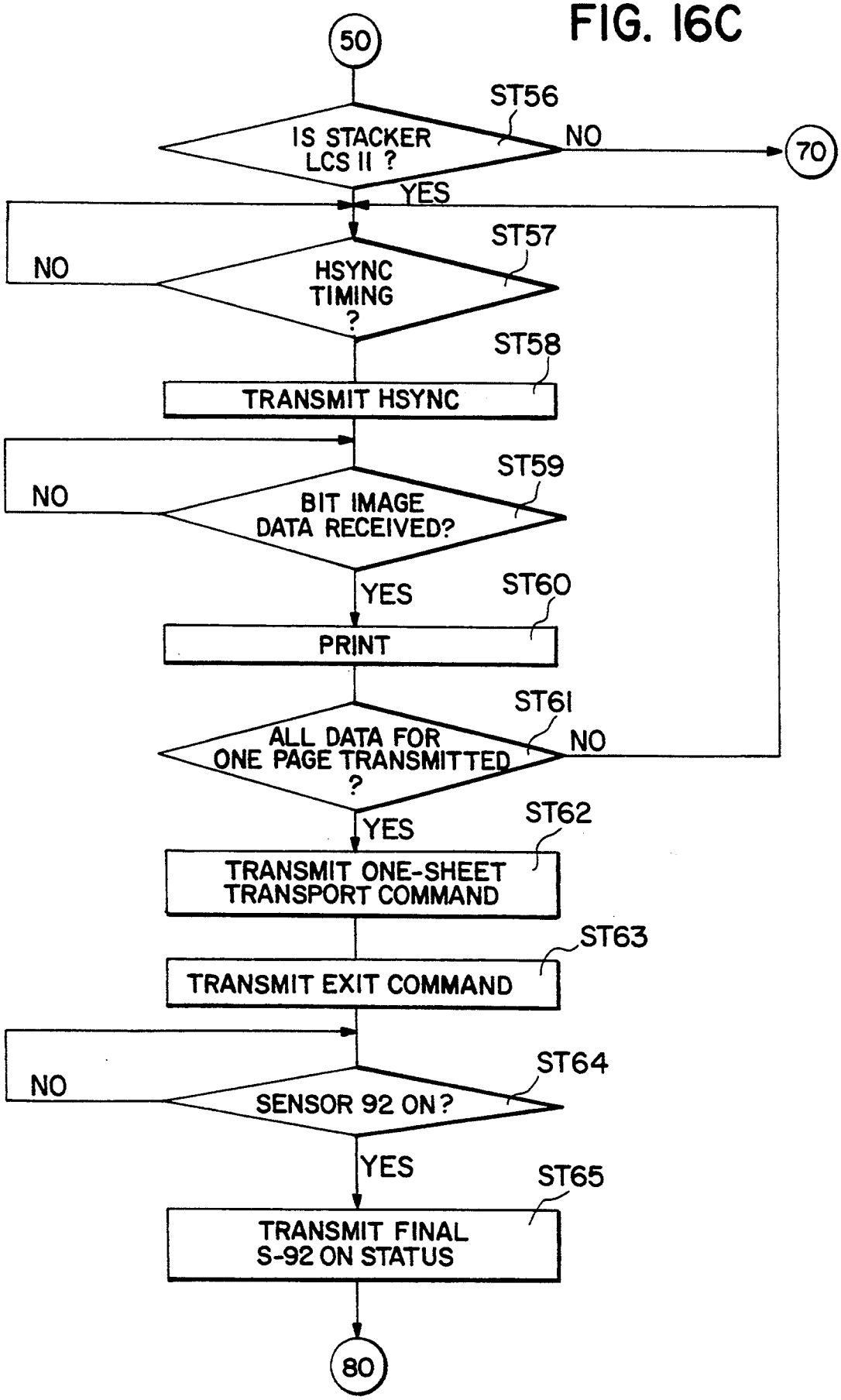
Figure 16D:
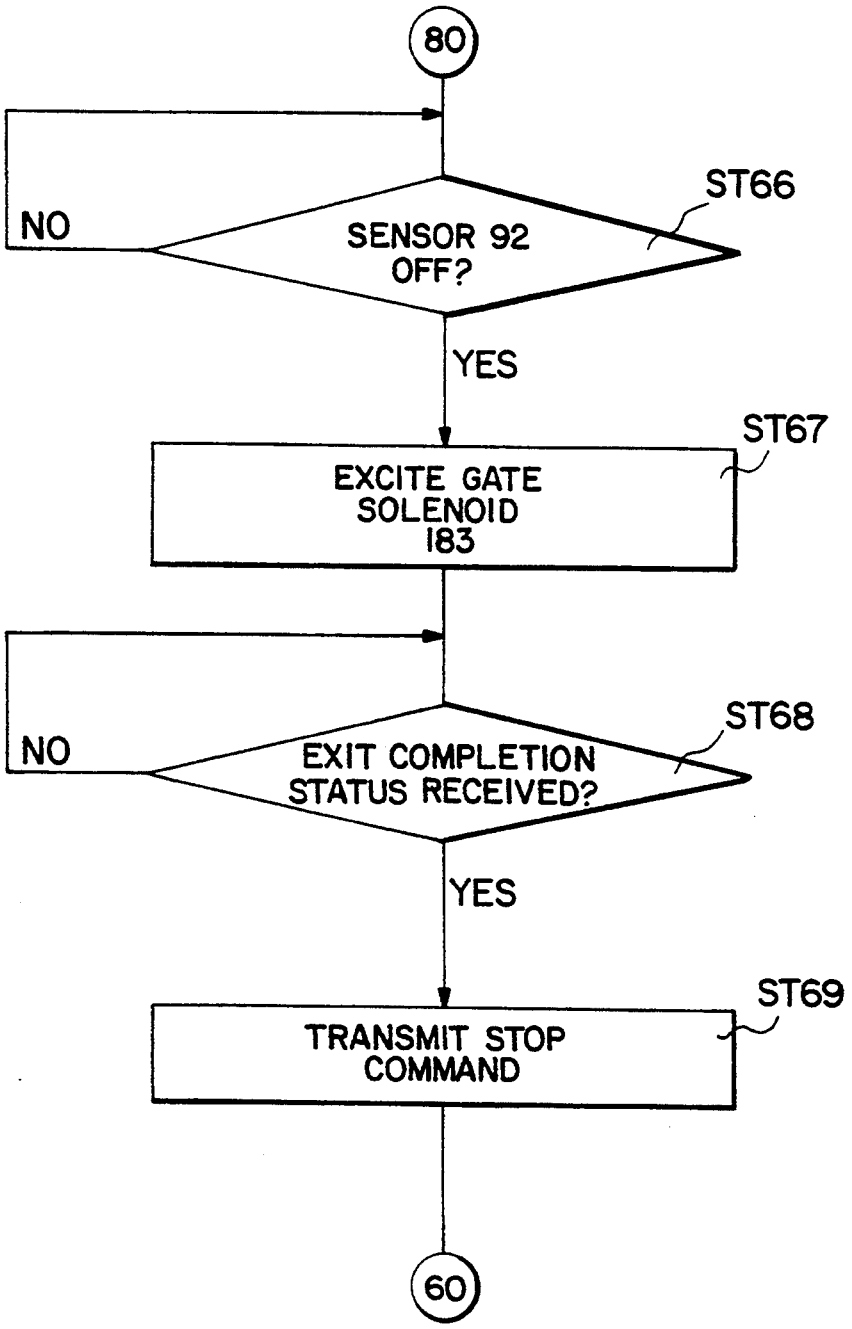

An operation of printer control section 18 of laser printer 1 will be described below with reference to flow charts shown in FIGS. 15A and 15B.

When laser printer 1 is set in the on-line state, CPU 260 checks whether a feeder selection command from host computer 3 or operation panel controller 272 is output (step ST1). If CPU 260 determines that the feeder selection command is output, then CPU 260 outputs a feeder indicating signal to engine control section 19 so that laser printer 1 forms an image to sheet P from the feeder corresponding to the feeder selection command, such as paper cassettes 54a and 54b, MPF 5 and LCF 9 (step ST2). If CPU 260 determines that the feeder selection command is not output, CPU 401 skips step ST2. In this case, engine control section 19 automatically selects paper cassette 54a.

After checking of the feeder selection command, CPU 260 checks whether a stacker selection command from host computer 3 or operation panel controller 272 is output (step ST3). If CPU 260 determines that the stacker selection command is output, then CPU 260 outputs a stacker indicating signal to engine control section 19 so that sheet P on which the image is formed by laser printer 1 is transported to the stacker corresponding to the stacker selection command (step ST4). If CPU 260 determines that the stacker selection command is not output, CPU 260 skips step ST4. In this case, engine control section 19 automatically selects exit tray 33 as a predetermined stacker.

Thereafter, CPU 260 checks whether the page buffer provided as a data-receiving buffer in the RAM 403 is full (step STS). If CPU 260 determines that the page buffer is full, then CPU 260 interrupts the data reception and completes the data receiving processing. On the other hand, if CPU 260 determines that the page buffer is not full, then CPU 260 checks whether the image data supplied from host computer 3 is received (step ST6).

If CPU 260 determines in step ST6 that no image data is received, the flow returns to step ST1 to repeatedly execute a series of steps, and laser printer 1 and the optional devices waits until the image data is received.

If CPU 260 determines in the step ST6 that the image data is received, the received image data is sequentially stored in the page buffer (step ST7). Thereafter, CPU 260 checks whether a print request is output from engine control section 19 (step ST8). In the case a print preparation of engine control section 19 is not completed, no print request is output. If CPU 260 determines that no print request is output, the flow returns to step ST1 to execute a series of steps again, and CPU 260 waits until a print request is output.

If CPU 260 determines in step ST8 that the print request is output, then CPU 260 transmits the print command to engine control section 19 (step ST9). Subsequently, CPU 260 checks whether the storage of the image data of one page in the page buffer is completed (step ST10). If the storage is not completed, then CPU 260 causes LED display 106 to flash through operation panel controller 272, for displaying a "DATA IN BUFFER" (step ST11). Thereafter, the flow returns to step ST1 to execute a series of steps, and CPU 260 waits until the image data of one page is stored in the page buffer. If CPU 260 determines that the storage of the image data of one page is completed by repeatedly executing a series of steps, then CPU 260 turns off the flashing LED 106 display and completes the data receiving processing (step ST12).

If CPU 260 determines in step ST5 that the page buffer is full, then CPU 260 interrupts the data reception, the flow advances step ST14 (step ST13).

When the data receiving processing is completed, CPU 260 checks whether the scan buffer provided in video RAM 264 is full (step ST14). If CPU 260 determines that the sum buffer is not full, then CPU 260 converts the image data stored in the page buffer into the bit image data of character image in accordance with predetermined line and character pitches, and stores the converted data in the video RAM 264 (step ST15). If CPU 260 determines in step ST14 that the scan buffer is full, the flow skips step ST15.

Subsequently, CPU 260 checks whether a vertical synchronization command ("V SYNC command") command is transmitted to engine control section 19 (step ST16). If CPU 260 determines that no VSYNC command is transmitted, then CPU 260 checks whether a vertical synchronization request ("VSYNC request") is output from engine control section 19 (step ST17). If CPU 260 determines that no VSYNC request is output, then the flow returns to step ST1 to repeatedly execute a series of steps, and CPU 260 waits until the VSYNC request is output from engine control section 19.

If CPU 260 determines in step ST17 that the VSYNC request is output, then CPU 260 transmits the VSYNC command to engine control section 19 (step ST18), and the flow returns to step ST1 to wait until a horizontal synchronization signal ("HSYNC") and video clock signal ("VCLK") of predetermined number of times are continuously input from engine control section 19. The input of the HSYNC and the VCLK represents the timing that printer control section 18 transmits a part of the bit image data to engine control section 19.

If CPU 260 determines in step ST16 that the VSYNC command is already transmitted, then CPU 260 checks whether front-cover switch 211 is off or lower limit switch is on (step ST19). If CPU 260 determines that front-cover switch 211 is off or lower limit switch is on, then CPU 260 transmits a changing signal ("CHANGE") to engine control section 19 (step ST20). When engine control section 19 receives the CHANGE and LCS 11 is selected as the stacker, engine control section 19 changes the stacker from LCS 11 to exit tray 80 so as to prevent sheet P from being transported to LCS 11. For this condition, CPU 260 transmits a DISPLAY command to operation panel controller 272. When receiving the DISPLAY command, operation panel controller 272 causes liquid-crystal display to display a "COVER OPEN" massage when front-cover switch 211 is off and a "SHEET FULL" command when lower limit switch is on. Thereby, the operator is informed that the change of the stacker is caused by the open of front-cover 210 or the sheet full condition.

If CPU 260 determines in step ST19 that front-cover switch 211 is on, then CPU 260 checks whether it is completed that the bit image data of one page is transferred from video RAM 264 to engine control section 19 (step ST21). If the transfer of the bit image data is not completed, CPU 260 transmits the bit image data in video RAM 264 to engine control section 19 in synchronism with the input of the HSYNC and the VCLK (steps ST22 and ST23). Thereafter, the flow returns to step 15 to repeatedly execute a series of steps until the transfer of the bit image data of one page is completed. If the transfer of the bit image data of one page is completed in this manner, the flow returns to step ST1. As a result, printer control section 18 returns to the initial state capable of transferring the bit image data of the next page.

An operation of engine control section 19 of laser printer 1 will be described below with reference to the flow chart shown in FIGS. 16A–16D.

Firstly, engine control section 19 checks whether a warming-up of the image forming section of laser printer 1 is completed (step ST30). After the completion of the warming-up, laser printer 1 is set in a ready state capable of performing a print operation, and transmits a print request to printer control section 18. (step ST31).

Thereafter, engine control section 19 waits until a print command is output from printer control section 18 (step ST32). When receiving the print command, engine control section 19 checks whether the feeder indicating signal is output from printer control section 18 (step ST33). If engine control section 19 determines that the feeder indicating signal is output, then engine control section 43 selects the feeder so that the image is formed on sheet P which is picked up from the feeder corresponding to the feeder indicating signal (step ST34). If engine control section 19 determines that no feeder indicating signal is output, then engine control section selects paper cassette 19*a* so that sheet P is picked up from paper cassette 19*a* (step ST35).

Subsequently, engine control section 19 checks whether the stacker indicating signal is output from printer control section 18 (step ST36). If engine control section 19 determines that the stacker indicating signal is output, then engine control section 19 selects the stacker so that sheet P on which the image is formed is transported to the stacker corresponding to the stacker indicating signal (step ST37). If engine control section 19 determines that no stacker indicating signal is output, then engine control section 19 selects exit tray 80 so that sheet P on which the image is formed is transported to exit tray 80 (step ST38).

If either MPS 9 or LCF 9 is selected as the feeder, engine control section 19 transmits a FEEDER-ON command to control circuit 19 or control circuit 20 (steps ST39 and ST40). When receiving the FEEDER-ON command, the feeder starts actuating.

Thereafter, engine control section 19 waits until it is time to send the VSYNC request (step ST41). If the time for sending the VSYNC request comes, engine control section 19 transmits the VSYNC request to printer control section 18 (step ST42). After that, engine control section 19 waits until the VSYNC command is output from printer control section 18 (step ST43). When receiving the VSYNC command, engine control section 18 checks whether the CHANGE is output (step ST44). If engine control section 19 determines that the CHANGE is output, then the flow advances a series of steps, which includes the steps of changing the stacker to exit tray 80.

If engine control section 19 determines that no CHANGE is output, then engine control section 19 waits until it is time to send the HSYNC to printer control section 18 (step ST45). If the time for sending the HSYNC comes, engine control section 19 transmits the HSYNC to printer control section 18 (step ST46). Engine control section 19 waits until the bit image data is output by printer control section 18 corresponding to the HSYNC and the VCLK (step ST47). The bit image data output by printer control section 18 corresponding to one HSYNC is data for one scan line which laser optical system 44 scans.

When receiving the bit image data, engine control section 19 actuates the image forming components such as high-voltage source 230, mechanism drive circuit 232, discharging lamp 52, laser optical system 44, fixing unit 78, and the like so as to carry out the printing according to the bit image data (step ST48).

Thereafter, engine control section 19 checks whether all the bit image data for one page of sheet P is transmitted (step ST49). If engine control section 19 determines that the transmission of all the bit image data is not completed, the flow returns to step ST44 to execute a series of steps. If engine control section 19 determines that the transmission of all the bit image data is completed, engine control section 19 checks whether the stacker is exit tray 80.

If the stacker is not exit tray 80 but LCS 11 or exit tray 29 of paper-reversing section 13, then engine control section 19 transmits a TRANSPORT command to each control circuit of the option devices through which sheet P is transported, and transmits a EXIT command to the control circuit of the option device onto which sheet P is stacked (steps ST51 and ST52). For example, if the stacker is LCS 11, then engine control section 19 transmits the TRANSPORT command to control circuit 22 of paper-reversing section 13, the control circuit 24 of paper-feeding section 14 and control circuit 26 of LCF 9, and transmits the EXIT command to control circuit 28 of LCS 11.

When the control circuit of the option device receives the TRANSPORT command, then the control circuit prepares for receiving sheet P and for transporting the received sheet P to the other option device. On the other hand, when the control circuit of the option device receives the EXIT command, the control circuit prepares for receiving sheet P on which the image is formed.

Subsequently, engine control section 19 waits until sensor 92 turns on (step ST53). When sensor 92 turns on, engine control section 19 transmits a S-92 ON status to control circuit 22 through control circuit 24 (step ST54). When receiving the S-92 ON status, control circuit 22 excites paper-feeding solenoid 310 so as to rotate transporting rollers 136a and 136b. Thereafter, engine control section 19 terminates the process, and the flow returns to step ST32.

If engine control section 19 determines in step ST50 that the stacker is exit tray 80, then engine control section 19 excites gate solenoid 243 so that gate 62 is turned and sheet P is guided to exit tray 80 (step ST55), and the flow returns to step ST32.

Next, the changing operation of the stacker by engine control section 19 is described below.

If engine control section 19 determines in step ST44 that CHANGE is output, then engine control section 19 checks whether the stacker is LCS 11 (step ST56). If the stacker is not LCS 11, then the flow returns to step ST45. If the stacker is LCS 11, then engine control section 19 advances to step ST57. From steps ST57 to ST61 engine control section 19 carries out the same series of steps as the series of steps ST45 to ST49.

In step ST61, if engine control section 19 determines that the transmission of all the bit image data is not completed, the flow returns to step ST57. If engine control section 19 determines that the transmission of all the bit image data is completed, then engine control section 19 transmits a ONE-SHEET TRANSPORT command to control circuit 22, control circuit 24 and control circuit 26, and transmits the EXIT command to control circuit 28 of LCS 11 (steps ST62 and ST63).

After that, engine control section 19 waits until sensor 92 turns on (step ST64). When sensor 92 turns on, engine control section 19 transmits a FINAL S-92 ON status to control circuit 22 through control circuit 24 (step ST65), and engine control section 19 waits until sensor 92 turns off (step ST66). When sensor 92 turns off, engine control section 19 excites gate solenoid 243 to turn gate 62 so that sheet P will be transported to exit tray 80 hereafter (step ST67).

Thereafter, engine control section 19 waits until the exit completion status is output from control circuit 28 of LCS 11 through control circuit 26 and control circuit 24 (step ST68). When receiving the exit completion status, engine control section 19 transmits a STOP command to the control circuits of the optional devices except LCS 11 (step ST69). When receiving the STOP command, the optional device stops the transporting operation. For this condition, engine control section 19 terminates the process, and the flow returns to step ST32, next sheet P is transported to exit tray 80.

Figure 17A:
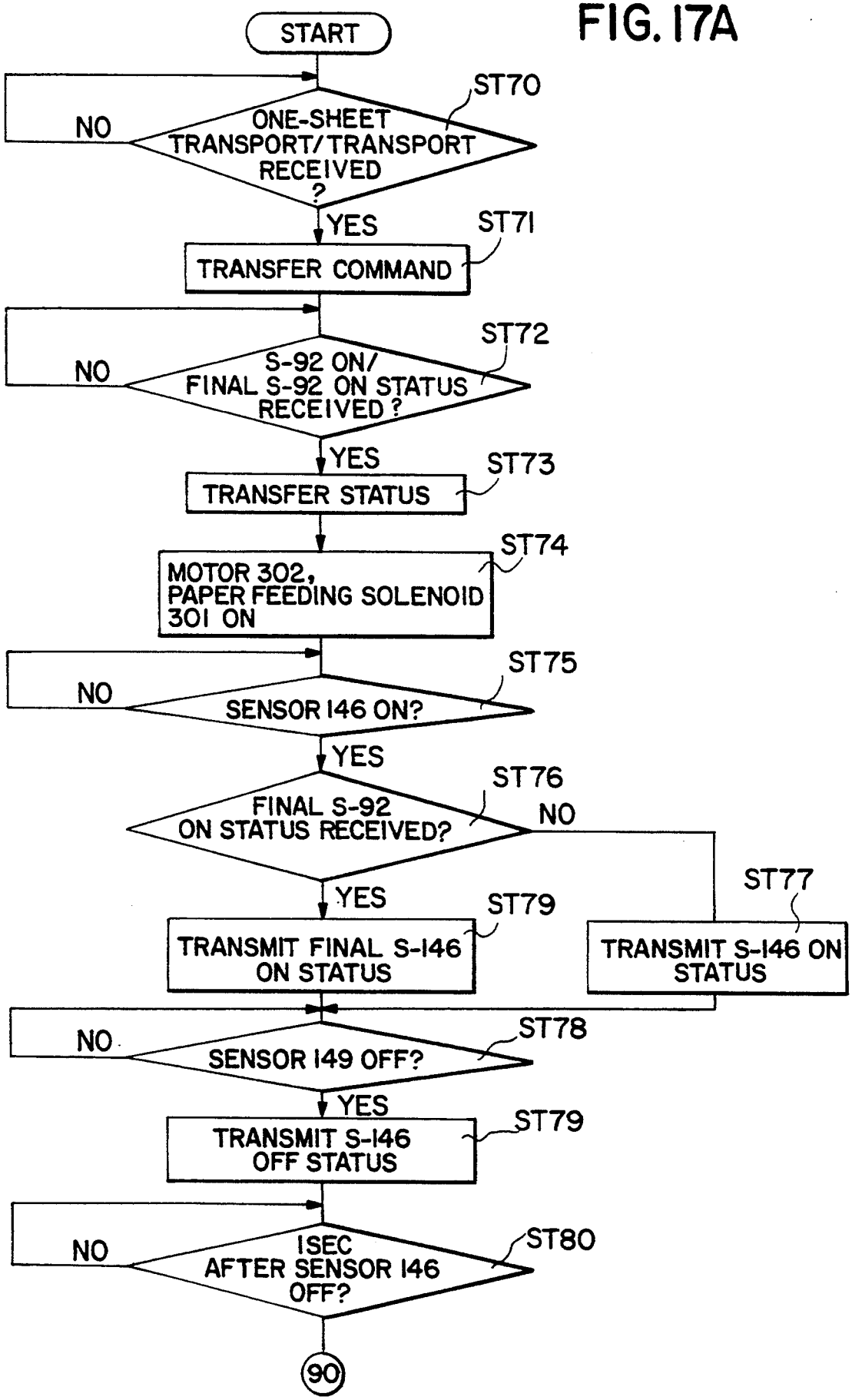
FIGS. 17A and 17B are flowcharts for explaining operations of the paper-reversing section and the paper-feeding section shown in FIG. 1.
Figure 17B:
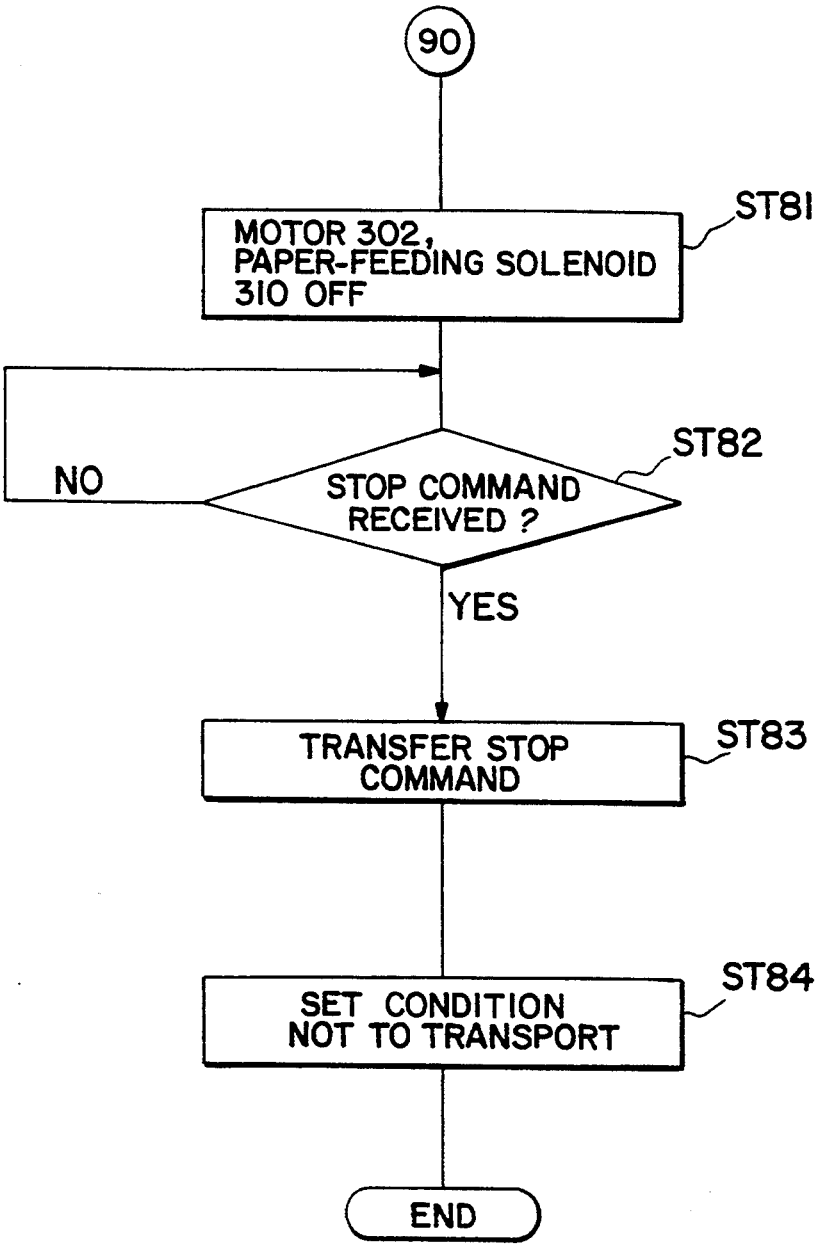

Next, the operation of paper-reversing section 13 and paper-feeding section 14 is described referring to the flowchart shown in FIGS. 17A and 17B. In this flow chart, the stacker is set to LCS 11.

Firstly, control circuit 24 waits until the ONE-SHEET TRANSPORT command or the TRANSPORT command is output from engine control section 19 through cable 221 (step ST70). When receiving the ONE-SHEET TRANSPORT command or the TRANSPORT command, the control circuit 24 transfers the command input to control circuit 22 through cable 224 (step ST71), control circuit 24 waits until the S-92 ON status or the FINAL S-92 ON status is output from engine control circuit 19 (step ST72). When receiving the status, control circuit 24 transmits the status to control circuit 22 (step ST73). When receiving the status, control circuit 22 drives motor 302 and excites paper-feeding solenoid 310 so that transporting rollers 136a and 136b transport sheet P by rotating (step ST74). For this condition, control circuit 24 waits until sensor 146 turns on (step ST75). When sensor 146 turns ON, control circuit 24 checks whether the input status is the FINAL S-92 ON status (step ST76). If control circuit 24 determines that the input status is not the FINAL S-92 ON status but the S-92 ON status, then control circuit 24 transmits a S-146 ON status to control circuit 26 through cable 222, and waits until sensor 146 turns off (steps ST77 and ST78). On the other hand, if control circuit 24 determines in step ST76 that the input status is the FINAL S-92 ON status, then control circuit 24 transmits a FINAL S-146 ON status to control circuit 26 (step ST79), and the flow advances to step ST78.

When sensor 146 turns off, control circuit 24 transmits a S-146 OFF status to control circuit 22 (step ST79). When receiving the S-146 OFF status, after 1 sec delay from sensor 146 off, control circuit 22 stops driving motor 302 and exciting of paper-feeding solenoid 310 (steps ST80 and ST81).

After that, control circuit 24 waits until the STOP command is output from engine control circuit 19 (step ST82). When receiving the STOP command, control circuit 24 transmits the STOP command to control circuit 22 (step ST83). When receiving the STOP command, control circuit 22 sets itself in the condition which does not transport sheet P (step ST84), and the process is terminated.

Figure 18:
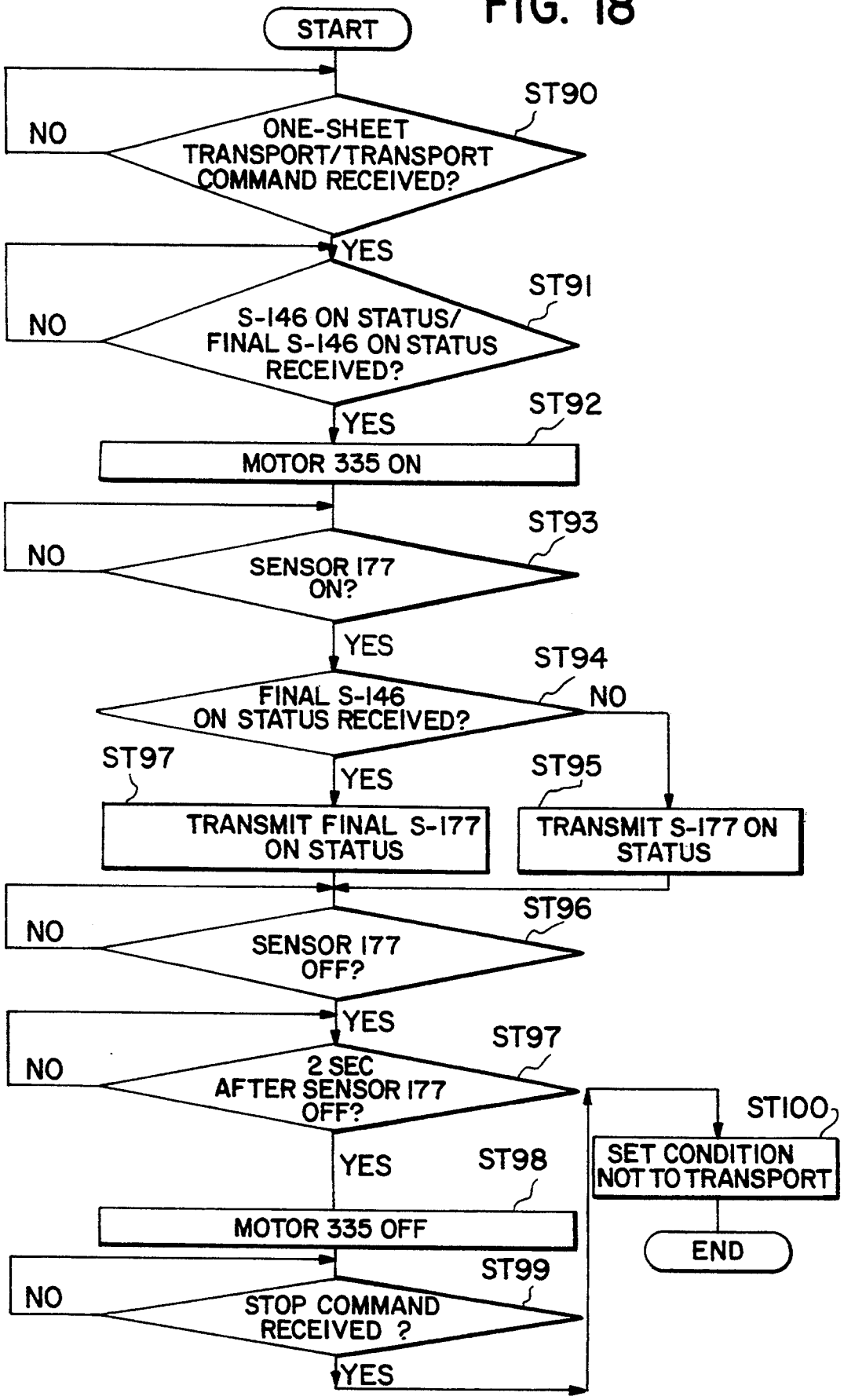
FIGS. 18 is a flowchart for explaining operations of the large-capacity feeder shown in FIG. 1.

The operation of LCF 9 is described below referring to the flowchart shown in FIG. 18. In this flow chart, the stacker is set to LCS 11.

Control circuit 26 waits until the ONE-SHEET TRANSPORT command or the TRANSPORT command is output from control circuit 24 through cable 222 (step ST90). When receiving the ONE-SHEET TRANSPORT command or the TRANSPORT command, the control circuit 24 waits until the S-146 ON status or the FINAL S-146 ON status is output from control circuit 24 (step ST91). When receiving the status, control circuit 26 drives motor 335 so as to transport sheet P by the rotation of paper-feeding rollers 176*a* and 176*b* (step ST92), and waits until sensor 177 turns on (step ST93). When sensor 177 turns ON, control circuit 26 checks whether the input status is the FINAL S-146 ON status (step ST94). If control circuit 26 determines that the input status is not the FINAL S-146 ON status but the S-146 ON status, then control circuit 24 transmits a S-177 ON status to control circuit 28 through cable 223 (steps ST95), and thereafter waits until sensor 177 turns off (step ST96).

On the other hand, if control circuit 26 determines in step ST94 that the input status is the FINAL S-146 ON status, then control circuit 26 transmits a FINAL S-177 ON status to control circuit 28 (step ST97), and the flow advances to step ST96. After 2 sec delay from sensor 177 off, control circuit 26 stops driving of motor 335, and thereafter waits until the STOP command is output from control circuit 24 (steps ST97, ST98 and ST99). When receiving the STOP command, control circuit 26 sets itself in the condition which does not transport sheet P (step ST100), and the process is terminated. However, it is possible to transport sheet P from storage section 160. Namely, for this condition, when control circuit 26 receives a command for requesting sheet P from engine control section 19, control circuit 26 drives motor 335 and excites paper-feeding solenoid 337 and aligning solenoid 339 so that sheet P is transported to laser printer 1.

Figure 19:
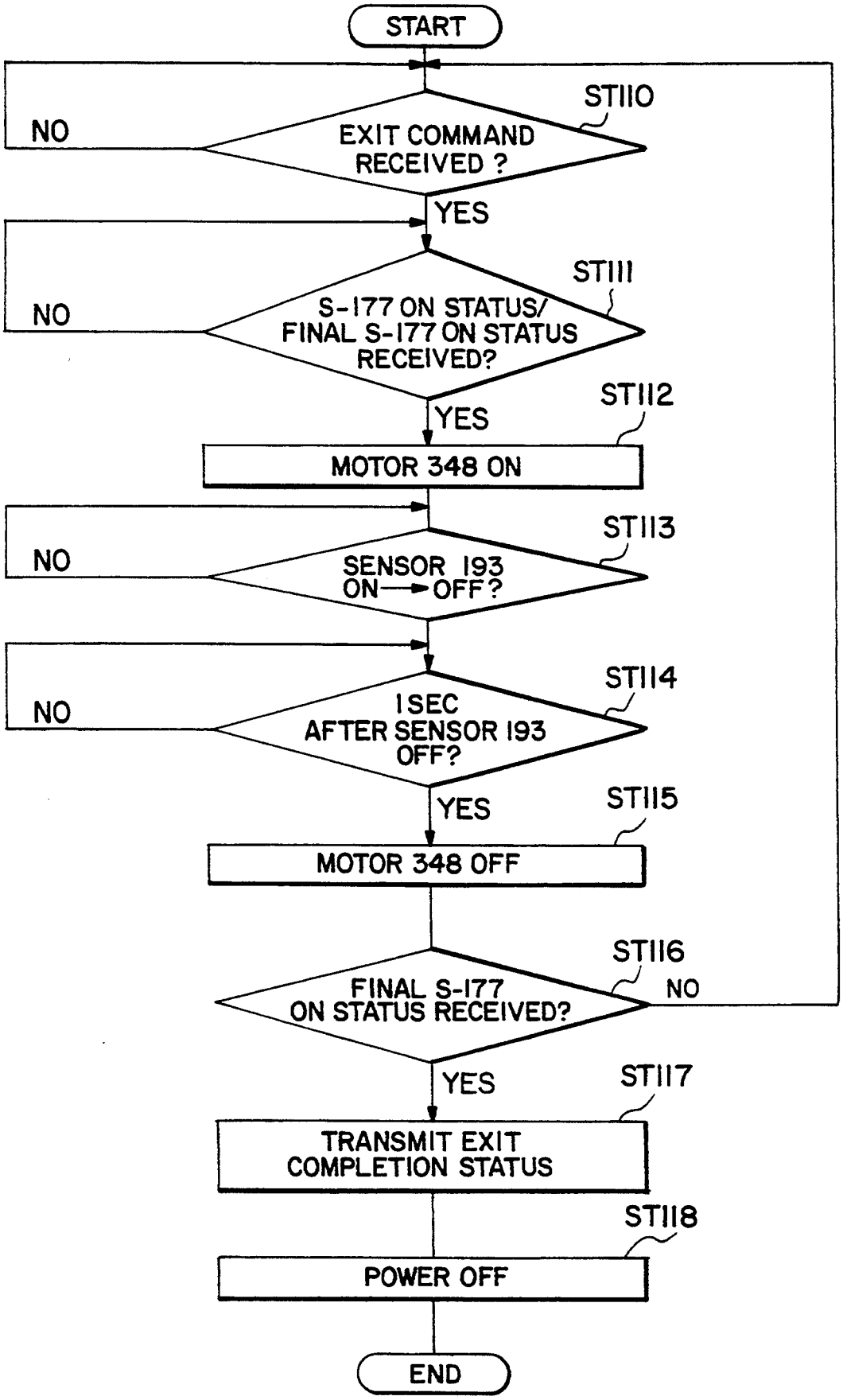
FIGS. 19 is a flowchart for explaining operations of the large-capacity stacker shown in FIG. 1.

The operation of LCS 11 is described below referring to the flowchart shown in FIG. 19. In this flow chart, the stacker is set to LCS 11.

Control circuit 28 waits until the "EXIT" command is output by engine control section 19 through cable 221, control circuit 24, cable 222, control circuit 26 and cable 223 (step ST110). When receiving the EXIT command, control circuit 28 waits until the S-177 ON status or the FINAL S-177 ON status is output from control circuit 26 (step ST111). When receiving the status, control circuit 28 drives motor 348 so as to transport sheet P rotating of exit rollers 196 (step ST112), and waits until sensor 193 turns on and turns off thereafter (step ST113).

After 1 sec delay from sensor 193 off, control circuit 28 stops driving of motor 348, and checks whether the input status is the FINAL S-177 ON status (steps ST114, ST115 and ST116). If control circuit 28 determines that the input status is the FINAL S-145 ON status, then control circuit 28 transmits the exit completion status to engine control section 19 through cable 223, control circuit 26, cable 222, control circuit 24, and cable 221 (step ST117). For this condition, control circuit 28 turns off the power to driver 345 and 347 (step ST118). If control circuit 28 determines in step ST116 that the input status is not the FINAL S-146 ON status but the S-146 ON status, the flow returns to step ST110. In this manner, the changing operation of the stacker is performed.

According to the present invention, the image forming system continues the image forming operation to the end when LCS 11 is full. Because upper limit switch 206 turns on before LCS 11 is perfectly full, for this condition, sheet P between laser printer 1 and LCS 11 is transported to LCS 11. Following sheet P is transported to exit tray 80 by gate 62.

In the same manner, the image forming system permits continuation of the image forming operation to the end when front cover 210 of LCS 11 is opened. Moreover, for this condition, the power is turned off by control circuit 28 after the transportation of a sheet is completed. Therefore, there is no danger.

Numerous modification and variations of the present invention are possible in light the above teachings. It is therefore to be understood that, within the scope of the appended claims, the present invention can be practiced in a manner other than as specifically described herein.

What is claimed is:

1. An image forming system for forming an image on a recording medium, comprising:

means for forming the image on the recording medium;

first receiving means for receiving the recording medium on which the image is formed by the forming means;

first transporting means for transporting the recording medium from the image forming means to the first receiving means;

second receiving means for receiving the recording medium on which the image is formed by the forming means;

means for accommodating the second receiving means;

an openable cover provided in the accommodating means; the cover permitting an operator to remove the recording medium in the second receiving means when the cover is opened;

second transporting means for transporting the recording medium from the image forming means to the second receiving means;

means for selecting one of the first receiving means and the second receiving means;

means for detecting the opening of the cover while the selecting means selects the second receiving means and the second transporting means is transporting the recording medium;

means for changing the selection of the selecting means from the second receiving means to the first receiving means corresponding to the detection by the detecting means; and means for driving the second transporting means until all of the recording medium in the second transporting means is transported to the second receiving means after the change of the selection by the changing means.

2. The system of claim 1, wherein the changing means includes means for turning off electric power to the second receiving means.

3. The system of claim 2, wherein the changing means includes means for displaying the reason why the changing occurred.

4. An image forming system for forming an image on a recording medium, comprising:

means for forming the image on the recording medium;

first receiving means for receiving the recording medium on which the image is formed by the forming means;

first transporting means for transporting the recording medium from the image forming means to the first receiving means;

a first housing for accommodating the forming means, the first receiving means and the first transporting means;

second receiving means for receiving the recording medium on which the image is formed by the forming means;

a second housing for accommodating the second receiving means;

an openable cover for the second housing, the cover permitting an operator to remove the recording medium in the second receiving means when the cover is opened;

second transporting means for transporting the recording medium from the image forming means in the first housing to the second receiving means in the second housing;

means for selecting one of the first receiving means and the second receiving means;

means for detecting the opening of the cover while the selecting means selects the second receiving means and the second transporting means is transporting the recording medium;

means for changing the selection of the selecting means from the second receiving means to the first receiving means corresponding to the detection by the first detecting means; and means for driving the second transporting means until all of the recording medium in the second transporting means is transported to the second receiving means after the change of the selection by the changing means.

5. The system of claim 4, wherein the changing means includes means for turning off electric power to the second receiving means.

6. The system of claim 5, wherein the changing means includes means for displaying why the changing operation occurred.

7. An image forming system for forming an image on a recording medium, comprising:

an image forming device;

means for forming the image on the recording medium to provide a printed recording medium, an exit tray for receiving the printed medium, and a first transporting mechanism for transporting the printed medium from the image forming medium to the exit tray;

a paper feeder, connected to a bottom side of the image forming device, for feeding the recording medium;

a stacking device, connected to a bottom side of the paper feeder, for receiving the printed medium;

means for accommodating the stacking device;

an openable cover for the accommodating means;

a second transporting mechanism for transporting the recording medium from the paper feeder to the image forming device;

a third transporting mechanism for transporting the printed medium from the image forming device to the stacking device in the accommodating means through the paper feeder;

a gate for switching between the first transporting mechanism and the third transporting mechanism;

means for selecting one of the exit tray and the stacking device;

first detecting means for detecting that the cover is open when the stacking device is selected;

means, responsive to the first detecting means upon detecting that the cover is open, for changing the selecting of the selecting means from the stacking device to the exit tray;

means, responsive to the changing of the selection to select the exit tray, for energizing the gate so that the printed medium is transported to the exit tray;

means, responsive to the energizing of the gate to select the exit tray, for driving the third transporting mechanism until all of the printed medium in the third transporting mechanism is transported to the stacking device;

second detecting means for detecting that all of the printed medium in the third transporting mechanism has been transported to the stacking device; and means for blocking the transporting of the printed medium by the third transporting mechanism in response to the detection of the second detecting means under an operable condition of the second transporting mechanism;

wherein the second transporting mechanism is maintained in an operable condition after the blocking means blocks the operable condition after the blocking means blocks the transporting of the printed medium.

* * * * *